US006884017B2

(12) United States Patent
Arrez et al.

(10) Patent No.: US 6,884,017 B2
(45) Date of Patent: Apr. 26, 2005

(54) RETRACTABLE LIFTER FOR REFUSE CONTAINER

(75) Inventors: Ramiro Arrez, Chicago, IL (US); Carlos Arrez, Berwyn, IL (US)

(73) Assignee: Perkins Manufacturing Company, La Grange, IL (US)

( * ) Notice: Subject to any disclaimer, the term of this patent is extended or adjusted under 35 U.S.C. 154(b) by 299 days.

(21) Appl. No.: 10/081,654

(22) Filed: Feb. 22, 2002

(65) Prior Publication Data

US 2002/0119034 A1 Aug. 29, 2002

Related U.S. Application Data

(63) Continuation-in-part of application No. 09/731,946, filed on Dec. 7, 2000, now Pat. No. 6,503,045.

(60) Provisional application No. 60/271,860, filed on Feb. 27, 2001, and provisional application No. 60/170,204, filed on Dec. 10, 1999.

(51) Int. Cl.[7] ..... B65F 3/00; B65F 3/02

(52) U.S. Cl. ..... 414/408; 414/406; 414/421

(58) Field of Search ..... 414/406, 408, 414/421, 420

(56) References Cited

U.S. PATENT DOCUMENTS

| | | | |
|---|---|---|---|
| 1,475,483 | A | 11/1923 | Galuska |
| 1,763,499 | A | 6/1930 | Bolger |
| 2,480,959 | A | 9/1949 | Presnell |
| 2,824,658 | A | 2/1958 | Beasley |
| 3,032,216 | A | 5/1962 | McCarthy |
| 3,040,919 | A | 6/1962 | Nolan |
| 3,136,436 | A | 6/1964 | Erlinder et al. |
| 3,147,870 | A | 9/1964 | Urban et al. |
| 3,170,580 | A | 2/1965 | Soyko |
| 3,211,312 | A | 10/1965 | Miller |

(Continued)

FOREIGN PATENT DOCUMENTS

| | | |
|---|---|---|
| AT | 243183 | 2/1965 |
| BE | 510235 | 4/1952 |
| CA | 622499 | 6/1961 |
| CH | 358747 | 1/1962 |
| CH | 453203 | 6/1968 |
| DE | 811 456 | 8/1951 |

(Continued)

OTHER PUBLICATIONS

Lifting Mechanism for a Sanitation Vehicle, U.S. patent application Ser. No. 378,823, filed May 12, 1982, now abandoned (bearing production Nos. B984–1005), with photographs (dated Dec., 1981) (bearing production Nos. B1082–1097), photographs of a present version of the above cited reference (bearing production Nos. B1098–1110A), and other related documents (bearing production Nos. 935–937, 939, 941–947, 948–977, 979, 981, 983, 1006–1025, and 1111–1125).

(Continued)

*Primary Examiner*—Eileen D. Lillis
*Assistant Examiner*—Sang Kim
(74) *Attorney, Agent, or Firm*—Cook, Alex, McFarron, Manzo, Cummings & Mehler, Ltd.

(57) ABSTRACT

A lifter is disclosed suitable for mounting on the underside of a refuse collection hopper of a refuse collection vehicle for dumping refuse collection containers into the refuse collection hopper. The lifter may include a lifter support movable between a first position below the hopper and a second position spaced from the first position, and a lifter carriage carried by the lifter support and pivotally movable between a retracted position and an extended position for lifting and inverting refuse collection containers to dump the refuse into the collection hopper. A power source is operatively connected to the lifter support and lifter carriage to move the lifter support between the first and second positions and the lifter carriage between a retracted and extended positions.

26 Claims, 15 Drawing Sheets

U.S. PATENT DOCUMENTS 3,270,902 A 9/1966 Breault
3,279,633 A 10/1966 Evers
3,327,876 A 6/1967 Kolling
3,415,169 A 12/1968 Naddell
3,516,562 A 6/1970 Knight
3,576,215 A 4/1971 Cline
3,576,265 A 4/1971 de Cordova et al.
3,662,910 A 5/1972 Herpich et al.
3,730,365 A 5/1973 Herpich et al.
3,732,997 A 5/1973 Reavis et al.
3,738,516 A 6/1973 Wells
3,747,785 A 7/1973 Dahlin
3,762,586 A 10/1973 Updike, Jr.
3,773,197 A 11/1973 Blakeley et al.
3,804,277 A 4/1974 Brown et al.
3,822,802 A 7/1974 Evans, Jr.
3,823,973 A 7/1974 Ramer
3,837,512 A 9/1974 Brown
3,841,508 A 10/1974 Ebeling et al.
3,844,434 A 10/1974 Blakeley et al.
3,861,547 A 1/1975 Sink, Sr.
3,884,376 A 5/1975 Rivers
3,894,642 A 7/1975 Shive
3,901,255 A 8/1975 Pettit
3,931,901 A 1/1976 Jones
3,944,092 A 3/1976 Ebeling et al.
3,954,194 A 5/1976 Stedman
3,964,624 A 6/1976 Werder
3,987,999 A 9/1976 Ryder
4,042,137 A 8/1977 Hughes et al.
4,057,156 A 11/1977 Thompson et al.
4,090,626 A 5/1978 Ebeling et al.
4,091,944 A 5/1978 Gollnick
4,096,959 A 6/1978 Schaffer
4,113,125 A 9/1978 Schiller
4,175,903 A 11/1979 Carson
4,219,298 A 8/1980 Stragier et al.
4,227,849 A 10/1980 Worthington
4,230,359 A 10/1980 Smith
4,237,857 A 12/1980 Sharp, Sr.
4,295,776 A 10/1981 Payne et al.
4,313,707 A 2/1982 Bingman et al.
4,345,868 A 8/1982 Rizzo et al.
4,348,147 A 9/1982 Helm
4,363,588 A 12/1982 Stickney
4,365,922 A 12/1982 Borders
4,372,726 A 2/1983 Lutz
4,401,407 A 8/1983 Breckenridge
4,422,814 A 12/1983 Borders
4,427,333 A 1/1984 Ebeling
4,435,117 A 3/1984 House
4,450,828 A 5/1984 Oaken et al.
4,461,607 A 7/1984 Smith
4,461,608 A 7/1984 Boda
4,479,751 A 10/1984 Wyman et al.
4,527,939 A 7/1985 Suarez
4,538,951 A 9/1985 Yeazel et al.
4,543,028 A 9/1985 Bell et al.
4,548,542 A 10/1985 Reese
4,557,658 A 12/1985 Lutz
4,566,840 A 1/1986 Smith
4,575,300 A 3/1986 George
4,597,710 A 7/1986 Kovats
4,597,712 A 7/1986 Smith
4,613,271 A 9/1986 Naab
4,669,940 A 6/1987 Englehardt et al.
4,673,327 A 6/1987 Knapp
4,687,405 A 8/1987 Olney
4,699,557 A 10/1987 Barnes
4,708,570 A 11/1987 Smith et al.
4,715,767 A 12/1987 Edelhoff et al.
4,722,658 A 2/1988 Wurtz et al.
4,726,726 A 2/1988 Dossena et al.
4,741,658 A 5/1988 Zelinka et al.
4,773,812 A 9/1988 Bayne et al.
4,844,682 A 7/1989 Edelhoff
4,872,801 A 10/1989 Yeazel et al.
4,909,564 A 3/1990 Pfeifer et al.
4,911,600 A 3/1990 Zelinka et al.
4,936,732 A 6/1990 Naab et al.
4,966,514 A 10/1990 Knapp
4,983,092 A 1/1991 Richards
4,992,018 A 2/1991 Prout et al.
5,002,450 A 3/1991 Naab
5,007,786 A 4/1991 Bingman
5,015,142 A 5/1991 Carson
5,015,143 A 5/1991 Carson
5,018,929 A 5/1991 Carson
5,024,573 A 6/1991 Redding et al.
5,026,104 A 6/1991 Pickrell
5,026,241 A 6/1991 Wyman
5,028,196 A 7/1991 Richards
5,035,563 A 7/1991 Mezey
5,049,026 A 9/1991 Bingman et al.
5,056,979 A 10/1991 Niederer
5,069,593 A 12/1991 Zelinka et al.
5,071,303 A 12/1991 Carson
5,071,307 A 12/1991 Carson
5,092,731 A 3/1992 Jones et al.
5,098,250 A 3/1992 Carson
5,114,304 A 5/1992 Edelhoff et al.
5,163,805 A 11/1992 Mezey
5,205,698 A 4/1993 Mezey
5,209,537 A 5/1993 Smith
5,230,393 A 7/1993 Mezey
5,257,877 A 11/1993 Zelinka et al.
5,266,000 A 11/1993 LeBlanc
5,303,841 A 4/1994 Mezey
5,308,211 A 5/1994 Bayne
5,333,984 A 8/1994 Bayne et al.
5,344,272 A 9/1994 Nuyts
5,360,310 A 11/1994 Jones et al.
5,391,039 A 2/1995 Holtom
5,466,110 A * 11/1995 Redding ..... 414/421
5,470,187 A 11/1995 Smith et al.
5,482,180 A 1/1996 Smith et al.
5,484,245 A 1/1996 Zopf
5,505,576 A 4/1996 Sizemore et al.
5,513,942 A 5/1996 Pickrell
5,551,824 A 9/1996 Zanzig et al.
5,562,386 A 10/1996 Browning
5,601,392 A 2/1997 Smith et al.
5,607,277 A 3/1997 Zopf
5,639,201 A 6/1997 Curotto
5,720,588 A 2/1998 Graves
5,720,589 A 2/1998 Christenson et al.
5,755,547 A 5/1998 Flerchinger et al.
5,769,592 A 6/1998 Christenson
5,775,867 A 7/1998 Christenson
5,791,861 A 8/1998 Seelig
5,797,715 A 9/1998 Christenson
5,807,056 A 9/1998 Osborn et al.
5,813,824 A 9/1998 Zanzig et al.
5,829,944 A 11/1998 Szinte
5,833,428 A 11/1998 Szinte
5,853,277 A * 12/1998 Everhart ..... 414/408
5,859,277 A * 1/1999 Whitlock et al. ..... 556/400
5,890,865 A 4/1999 Smith et al.
6,059,511 A 4/1999 Anderson et al.
6,095,744 A 8/2000 Harrison
6,139,244 A 10/2000 VanRaden

| | | | |
|---|---|---|---|
| 6,158,945 | A | 12/2000 | Anderson |
| 6,167,795 | B1 | 1/2001 | Bayne et al. |
| 6,183,185 | B1 | 2/2001 | Zanzig et al. |
| 6,413,031 | B1 | 7/2001 | Yakley et al. |
| 6,293,863 | B1 | 9/2001 | Carr et al. |
| 6,325,587 | B1 | 12/2001 | Wysocki et al. |
| 6,357,988 | B1 | 3/2002 | Bayne |
| 6,439,667 | B1 | 8/2002 | Weets et al. |
| 6,503,045 | B2 | 1/2003 | Arrez et al. |
| 6,551,046 | B1 | 4/2003 | Dorrington |
| 2001/0046430 | A1 | 11/2001 | Bayne |
| 2002/0119034 | A1 | 8/2002 | Arrez |
| 2002/0141854 | A1 | 10/2002 | Arrez |
| 2002/0141855 | A1 | 10/2002 | Arrez |
| 2003/0099529 | A1 | 5/2003 | Arrez |

FOREIGN PATENT DOCUMENTS

| | | |
|---|---|---|
| DE | 844 262 | 3/1952 |
| DE | 1 226 035 | 9/1966 |
| DE | 1 236 403 | 3/1967 |
| DE | 2 146 653 | 3/1967 |
| DE | 1531 763 | 1/1970 |
| DE | 2 051 270 | 10/1970 |
| DE | 30 24 081 | 1/1981 |
| DK | 82300 | 6/1954 |
| EP | 0 078 011 | 4/1983 |
| EP | 0 312 900 | 4/1989 |
| EP | 0 405 428 | 1/1991 |
| EP | 575 867 | 12/1993 |
| FR | 2 272 002 | 12/1975 |
| FR | 2 459 779 | 1/1981 |
| FR | 2 479 783 | 10/1981 |
| FR | 2 500 425 | 8/1982 |
| GB | 291709 | 6/1928 |
| GB | 2 078 196 | 1/1982 |
| GB | 2 080 757 A | 2/1982 |
| GB | 2 188 302 | 9/1987 |
| SU | 751794 | 7/1980 |
| SU | 253 892 | 8/1986 |
| WO | WO 83/03242 | 9/1983 |
| WO | WO 91/00231 | 1/1991 |
| WO | WO91/05721 | 5/1991 |
| WO | WO92/01612 | 2/1992 |
| WO | WO93/25457 | 12/1993 |
| WO | WO94/21540 | 9/1994 |

OTHER PUBLICATIONS

Refuse Removal Systems, Inc., "Waste Wheeler," Waste Age, 1982 (with photographs of the device bearing production Nos. B913–922).

Rubbermaid "Mobile Toter."

McKagen, World Wastes, "Supercan! Can . . . And Does," Jun. 1983, pp. 24–26.

Waste Age, Mar. 1982, pp. 31–33.

U.S. patent application No. 10/102,060, (pending) to Arrez et al. including PTO filing receipt, specification, claims, abstract, and drawings.

U.S. patent application No. 10/081,654, (pending) to Arrez et al. including PTO filing receipt, specification, claims, abstract, and drawings.

Perkins Mfg. Brochure: "The Original Rotary Tuckaway," Model D6080–20K, (2 pages).

Zöller–Kipper GMBH Brochure "Zöller System," (11 pages).

Bayne Brochure Thinline® Grabber Lifter, Model GTLS 1110, undated, (2 pages).

Zarn Model "D" sales brochure, printed prior to Mar. 20, 2002.

Taskmaster Lifter features/specification from: http://www.baythinline.com/products–taskmaster.htm.

Arrez et al., U.S. Appl. No. 10/767,041, filed Jan. 29, 2004, entitled "Heavy Duty Cart Lifter".

Arrez et al., U.S. Appl. No. 10/691,989, filed Oct. 23, 2003, entitled "Receptacle Lifter With Retractable Gripper Arms".

U.S. Appl. No. 10/718,336, filed Nov. 20, 2003, entitled "Front Mounted lifter for Front Load Vehicle".

* cited by examiner

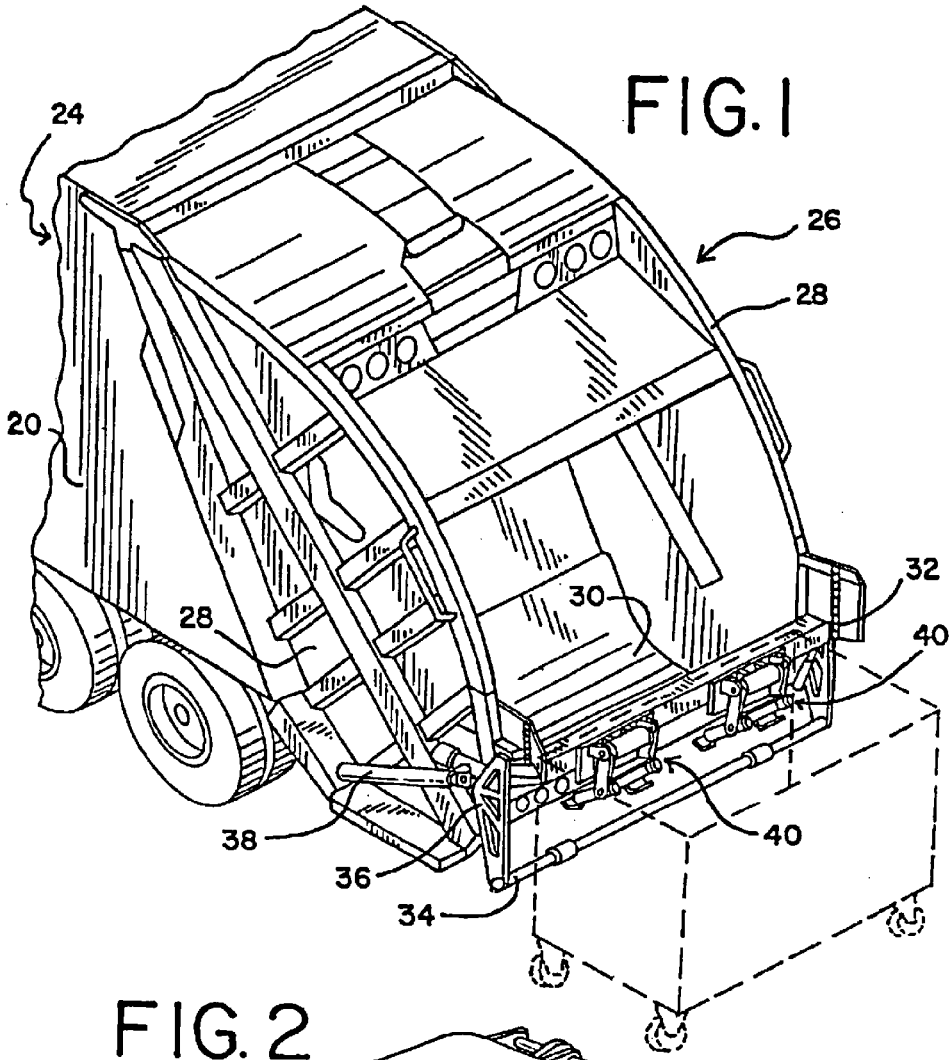
FIG. 1
FIG. 2
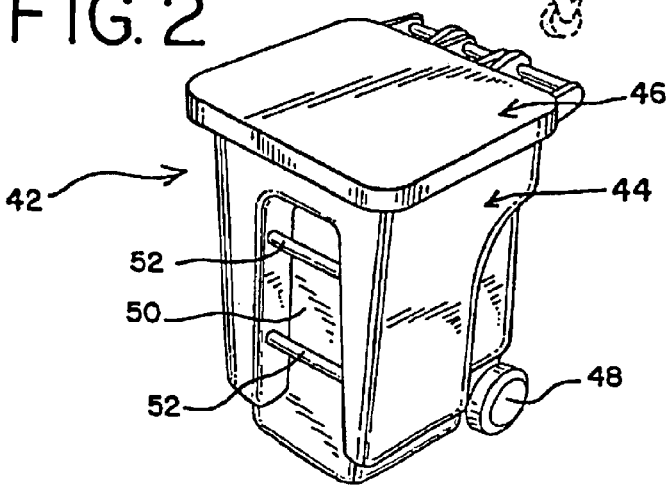

RETRACTABLE LIFTER FOR REFUSE CONTAINER

This application claims the benefit of Provisional Application Ser. No. 60/271,860 filed Feb. 27, 2001, and is a continuation-in-part of U.S. patent application Ser. No. 09/731,946 filed Dec. 7, 2000, now U.S. Pat. No. 6,503,045, which claims the benefit of Provisional Application Ser. No. 60/170,204 filed Dec. 10, 1999.

BACKGROUND OF THE INVENTION

Refuse container lifters have been used for many years in a wide variety of settings. They have, for example, been mounted on refuse collection trucks, both rear and side load trucks. They have been mounted on larger multi-cubic yard refuse containers and they have been used in stationary refuse loading stations. An example of one successful refuse container lifter may be found in U.S. Pat. No. 4,741,658 to Zelinka and Redding. That patent is owned by the Perkins Manufacturing Company, which makes and sells a variety of lifters, including its well-known TuckAway lifter. Despite the wide variety of lifters being offered for sale, there continues to be need for lifters that have improved reliability and/or function; that are suitable for variety of applications on trucks, containers or stationary refuse collection stations; and/or that may be more efficiently manufactured at reduced cost.

Additionally, one of the drawbacks with many lifters relates to the way they are mounted on the collection truck, particularly rear-loading trucks. Such trucks, commonly have an upwardly sloping hopper that terminates in a rear hopper sill which lends rigidity and strength to the truck body.

When mounting lifters on such a truck, it is not uncommon to mount the lifter in a recess or cut-out in the sill or in a sill extension. The recessed location protects the lifter against damage when the truck is backed against a loading lock or other obstacles or when larger commercial loading containers are positioned against the back of the truck for dumping.

Cutting into the truck manufacturer's sill, however, may weaken the truck body and lessen its useful life. Employing a sill extension adds additional depth to the back of the truck which some consider undesirable because it increases the distance from the rear edge of the truck and the hopper floor.

Accordingly, it is an object of the present invention to provide a lifter for lifting, tilting and dumping residential-style refuse containers that has improved reliability.

It is a further object of the present invention to provide a refuse container lifter that is adapted for use in a variety of applications, such as on trucks, containers, or stationary refuse collection stations and also does not interfere with the use of lifters for other types of containers.

Accordingly, it is an object of the present invention to provide a lifter for lifting, tilting and dumping residential-style refuse containers that can be mounted with fewer modifications and without the need to cut into the manufacturer's hopper sill or sill extension.

It is a further object to provide a lifter that may be mounted below the hopper and be movable to an extended position (for dumping a rollout container) without interfering with other apparatus, such as a tipper bar, which is used for dumping larger commercial containers.

It is still a further object of the present invention to provide a refuse lifter that can move or retract to a position where it will not substantially interfere with dumping larger commercial containers or positioning against a loading dock.

It is a still further object of the present invention to provide a refuse container lifter that may be efficiently and economically manufactured.

SUMMARY OF THE INVENTION

One or more of these objects, and others which will become apparent upon reference to the following drawings and detailed description, are achieved by a lifter assembly suitable for mounting on the underside of a refuse collection hopper of a refuse collection vehicle for dumping refuse collection containers into the refuse collection hopper. Such a lifter may include a lifter support movable between a first position below the hopper floor and a second position spaced from the first position, and a lifter carriage carried by the lifter support and pivotally movable between a retracted position and an extended position for lifting and inverting refuse collection containers into the hopper. A power source is operatively connected to the lifter support and lifter carriage to move the lifter support between the first and second positions and the litter carriage between the retracted and extended positions. This motion is preferably at least in part sequential with the movement of the lifter support first and then the movement of the lifter carriage as the lifter is moved to dump a container and in reverse order when the lifter is being retracted after dumping.

The lifter may further comprise a linkage assembly pivotally connected to the lifter carriage and lifter support, with the power source being secured to the linkage assembly. The power source is preferably hydraulically actuated, such as a piston-cylinder unit, although telescopic piston-cylinder unit which has a relatively short cylinder length is preferred.

More specifically the lifter may include a first link having first and second ends, the first end being pivotally mounted to the lifter support, a second link having first and second ends, the first end being pivotally mounted to the lifter carriage. The second ends of the first and second links are preferably pivotally secured together, and the power source is operatively coupled to the first and second links. The power source in this arrangement may comprise a linearly movable actuator, with the actuator pivotally secured to selected of the links, such as the first or second link or to a common connecting member. A connecting rod may be provided extending between and pivotally connecting the second ends of the links along a common axis, with the actuator secured to the connecting rod.

To retain the lifter support in the second position during dumping, a lock may be provided that engages the support when it reaches the second position and is releasable upon movement of the lifter carriage to the retracted position.

Although the above and other features may differ without departing from the present invention, the preferred lifter further comprises a slide track for attachment to the underside of the collection hopper, the lifter support being slidably movable within the slide track. The lifter carriage preferably includes relatively movable upper and lower hooks, the hooks being movable between a first spaced apart position when the lifter carriage is in the retracted position and a second spaced apart position when the lifter is in the extended position, the hooks being spaced apart a greater distance in the second position than in the first position to capture the lift bars or surfaces of a refuse collection container.

BRIEF DESCRIPTION OF THE DRAWINGS

FIG. 1 is perspective view of a refuse collection truck, partially removed, of a rear-loading refuse collection truck including two lifters in accordance with at least on aspect of the present invention, and with a larger multi-cubic yard container shown in dashed lines. Of course, the lifter is shown on a rear-loading truck for purposes of illustration not limitation.

FIG. 2 is a perspective view of a typical residential collection container used with the lifter of the present invention. The drawings of FIGS. 1 and 2 are not to the same scale, and the container in FIG. 2 is actually of much smaller capacity (e.g., 90 gallons) compared to the multi-cubic yard container in FIG. 1.

DETAILED DESCRIPTION OF THE PREFERRED EMBODIMENTS

Figure 3A:
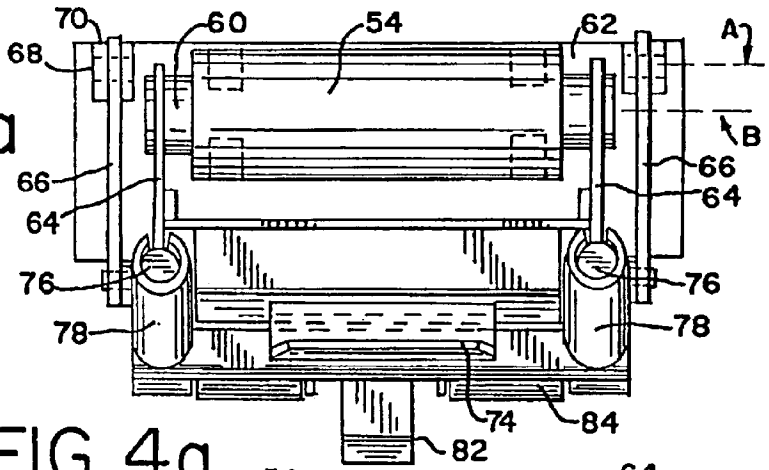
FIG. 3*a* is an elevational view of the lifter of FIG. 3.
Figure 4A:
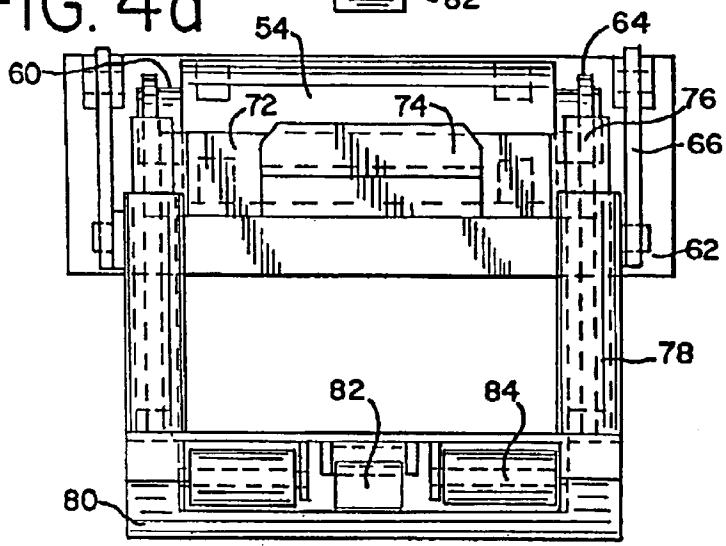
FIG. 4*a* is a front view of the lifter in FIG. 4.

FIG. 1 illustrates a typical rear loading refuse collection truck of the type having a pair of sidewalls 20, a top wall 22, and bottom wall (not shown) forming a refuse collection body, generally at 24. A rear load hopper assembly, generally at 26, is mounted at the back of the collection body and includes sidewalls 28 and a curved bottom hopper wall 30. The bottom hopper wall slopes upwardly toward a rearward sill or sill edge 32, over which refuse is dumped into the collection hopper.

The collection truck illustrated in FIG. 1 is adapted for dumping very large, multi-cubic yard containers, commonly referred to as dumpsters, one of which is shown in dashed lines in FIG. 1, as well as much smaller residential style containers (as shown for example in FIG. 2). For dumping the large containers a tipper or kick bar 34 is pivotally attached to the back of the truck by a bracket 36 that is rotated by a hydraulic cylinder 38. When a large container is to be dumped, the container is rolled into position adjacent the sill area of the collection truck. A trunnion bar, which extends along one edge of the container, is captured by a latching mechanism, such as is shown in U.S. Pat. No. 5,720,588, or in a slot that extends along the sill of the truck. The container is lifted and tilted by rotating it about the trunnion bar. In the illustrated truck, this is done by the tipper bar 34 which is rotated from under the truck and pushed against the front side of the container, lifting and tilting it. Other trucks have other mechanisms for lifting and tilting containers, such as a cable and winch.

For dumping smaller, residential style containers, the refuse collection truck in FIG. 1 includes two lifters 40 embodying a first aspect of the present invention mounted at the rear, although only one could also be used. The lifters 40 embodying this aspect of the present invention are shown on the particular truck illustrated in FIG. 1 solely for purposes of illustration. The lifters of the present invention may also be used on trucks that use a cable and winch system for dumping large multi-yard containers or on trucks devoted solely to residential pick-up. In addition, lifters 40 may be used on side load trucks, (in which refuse is added through a side opening), may be mounted on the larger multi-yard containers (with suitable hydraulic attachments to a source of hydraulic fluid power), or may be mounted on stationary refuse dumping stations. As will be described in more detail later, the lifter 40 of the present invention may be advantageously used with tipper bar-equipped trucks because the lifter retracts to a size and position clear of the path of travel of the tipper bar, so as not to interfere with tipper operation when large multi-yard containers are being dumped.

Before turning to a more detailed description of the lifter 40, reference is made to FIG. 2, which shows a typical residential roll out container 42 for which the present lifter is intended. The typical container 42 is made of rigid plastic construction, with a body 44 and a hinged lid 46. A pair of wheels 48 allow the container to be conveniently moved curbside or to another pickup location. The front side of the container includes a generally recessed area 50 to accommodate lifter units on the refuse collection vehicle. For cooperation with such lifters, a pair of parallel, spaced-apart lift bars 52 are firmly secured in the container body in the area recessed 50. Lid 46 is hingedly connected to the body, so that the lid is naturally opened by gravity when the container is inverted for dumping. It should be understood that refuse collection containers of the type shown, are available in a variety of styles and designs, and the present invention is not limited to any particular type style or design of refuse collection container.

Figure 5A:
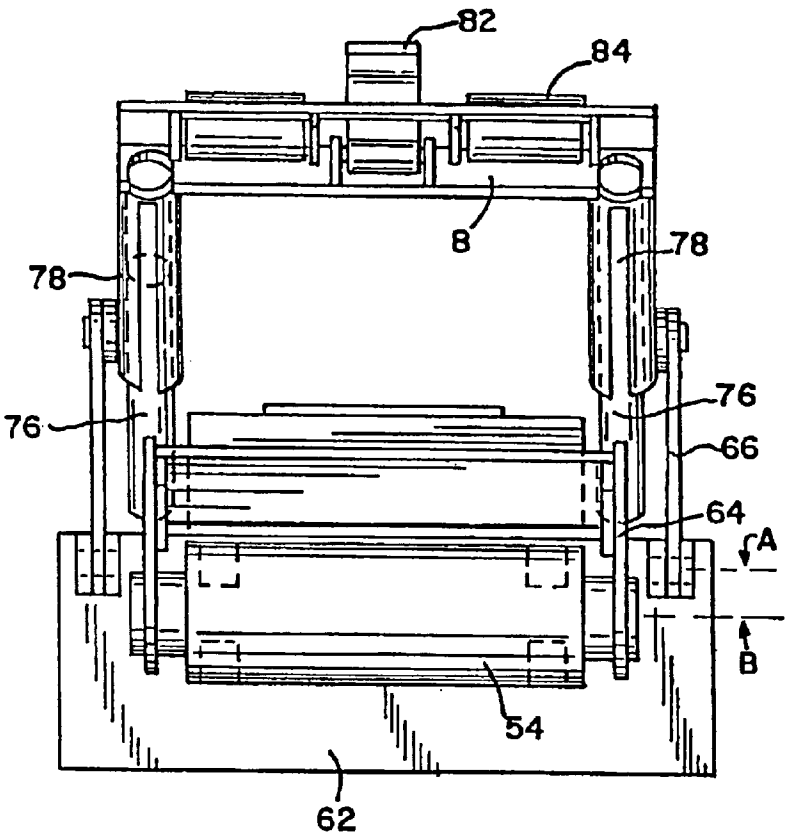
FIG. 5*a* is an elevational view of the lifter in FIG. 5.
Figure 5:
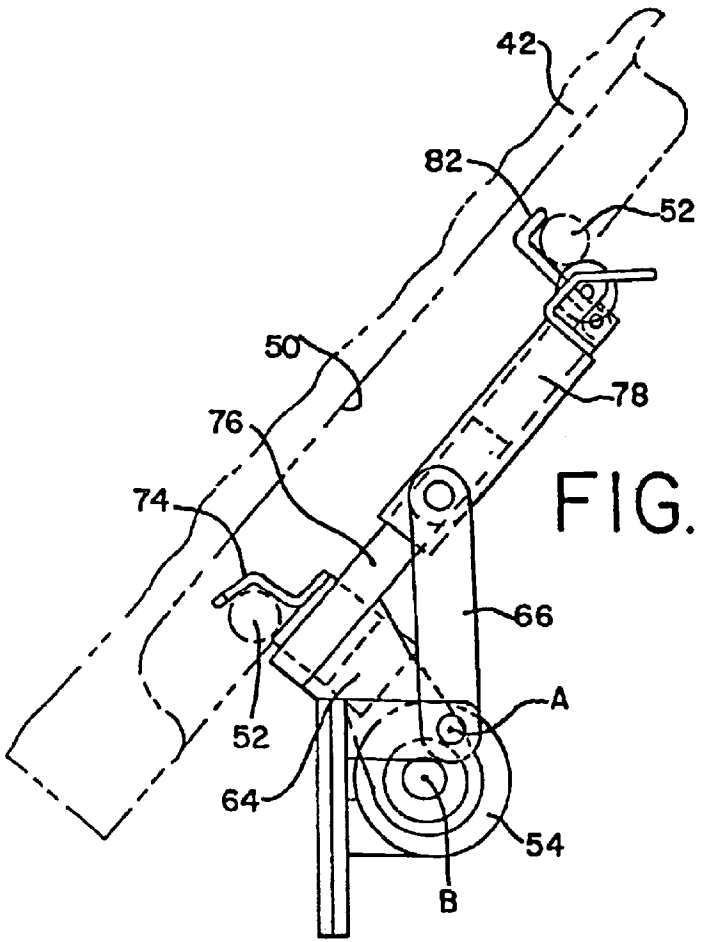
FIG. 5 is a side view of the lifter of FIG. 1 in its extended position for lifting, tilting and dumping a refuse collection container that is shown partially in dashed lines.
Figure 6:
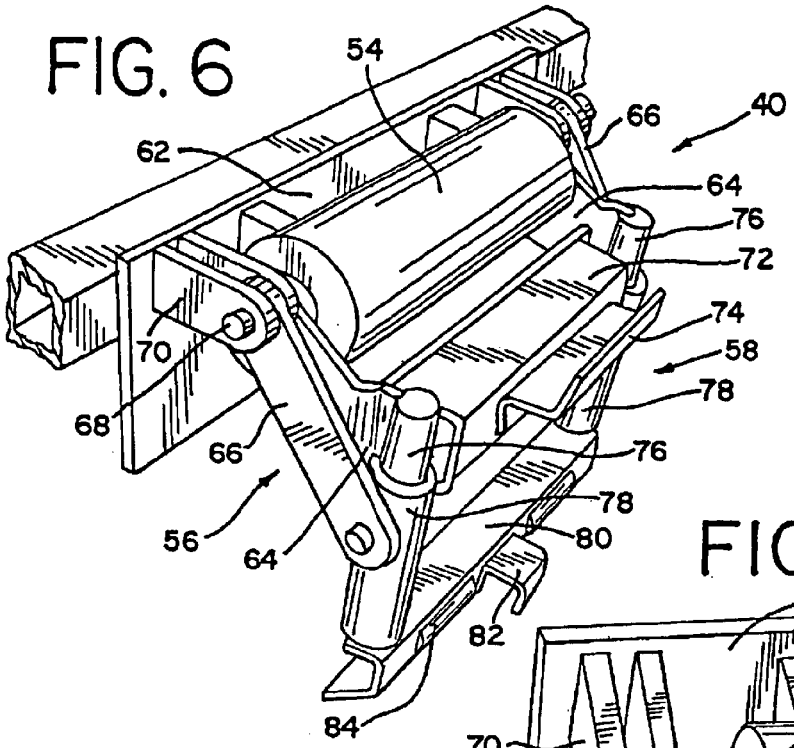
FIG. 6 is a perspective view of the lifter of FIG. 1.
Figure 7:
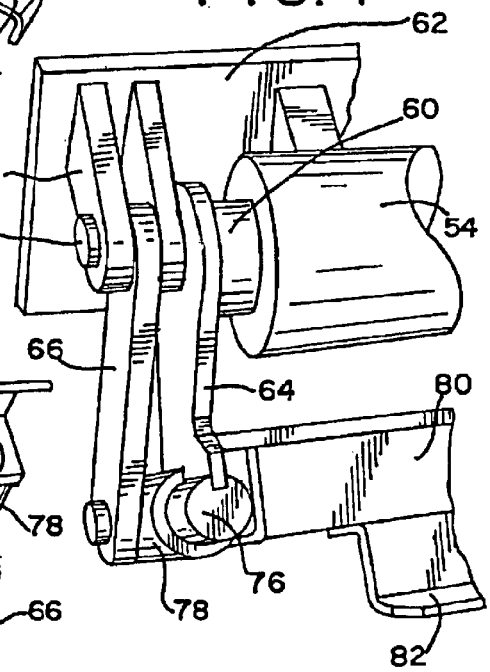
FIG. 7 is an enlarged perspective view, partially removed, of one side of the lifter of FIG. 6, depicting the lift and actuator linkages, hydraulic motor and carriage.

The lifter 40 embodying the first aspect of the present invention is perhaps best seen in FIG. 6, a perspective view of the lifter in an intermediate position between the retracted position (as in FIGS. 3 and 3*a*) and the fully raised and inverted position (as in FIGS. 5 and 5*a*). The lifter 40 of the present invention includes a rotary hydraulic motor or actuator 54, at least one lift arm and actuator arm generally at 56, and a container carriage, generally at 58. The hydraulic motor 54 has a generally horizontal rotary actuator shaft 60 (see FIG. 7) that extends through at least one end of the motor, and preferably through each end of the motor. The motor 54 may be of any suitable design. Most preferably, the motor or actuator is an HS series helical hydraulic shaft rotary actuator, as supplied by Helac Corporation of Enumclaw, Wash. These actuators are available in a variety of torque capabilities, and Model HS-15K is believed suitable for the present application. The motor 54 is attached, as by welding or bolting, to a mounting or base plate 62.

For lifting the container carriage, a lift arm 64 is attached to the actuator shaft 60 of the hydraulic motor 54, and preferably a lift arm is fixed to each end of the shaft. The other end of the lift arm is attached, as by welding, bolting or other attachment, to the carriage, as will be described in more detail later. For inverting the carriage, an actuator arm 66 is pivotally mounted at 68 to the base plate 62 at a location beyond the end of the motor actuator shaft. Each actuator arm 66 is pivotally mounted to a bracket 70 that is welded or otherwise attached to the base plate. As will be described in more detail later, the axis of rotation at the pivot 68 is displaced from and located above the axis of rotation of the motor actuator shaft. The other end of each actuator arm 64 is pivotally attached to the carriage, as discussed in more detail below.

The container carriage of the present invention may be of various constructions, such as an open frame, a solid face plate or other variations common in the lifter art. In the illustrated embodiment of the present invention, the carriage includes an upper cross member 72 that carries a hook or saddle 74 that serves to hook under the uppermost lift bar 52 on the refuse container 42 as the lifter is moved from the retracted to the extended position. Each end of the upper cross member 72 is welded or otherwise attached, directly or indirectly, to a lift arm 64 so that as the lift arm is rotated by the hydraulic motor 54, the cross member 72 is also raised or lowered.

Each side of the carriage in the illustrated embodiment includes two relatively movable or telescoping members 76 and 78. These members could be provided separately from the carriage, but making them part of the carriage reduces the number of parts and thus the material and labor costs. Inner telescoping member 76, as illustrated, is a solid cylindrical steel rod, and is attached directly or indirectly to the end of the lift arm 64 as, for example, by welding. Outer telescoping member 78, as illustrated, is a steel sleeve or tube including a slot 79 and is pivotally attached to the end of the actuator arm 66. A lower cross member 80 of the carriage extends between and is attached to each of the outer telescoping members 78. The lower cross member 80 includes a downwardly facing hook or saddle 82 for engaging over the lowermost lift bar 52 of a refuse collection container 42.

Figure 3:
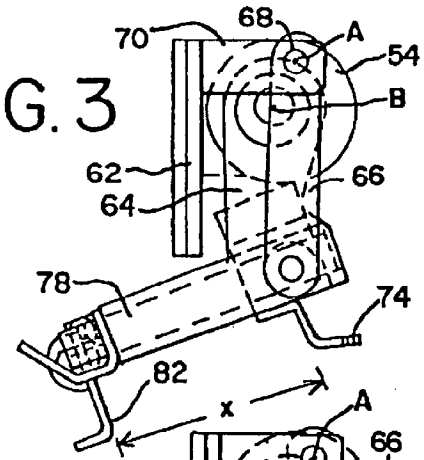
FIG. 3 is a side view of the lifter of FIG. 1 in its retracted position.
Figure 4:
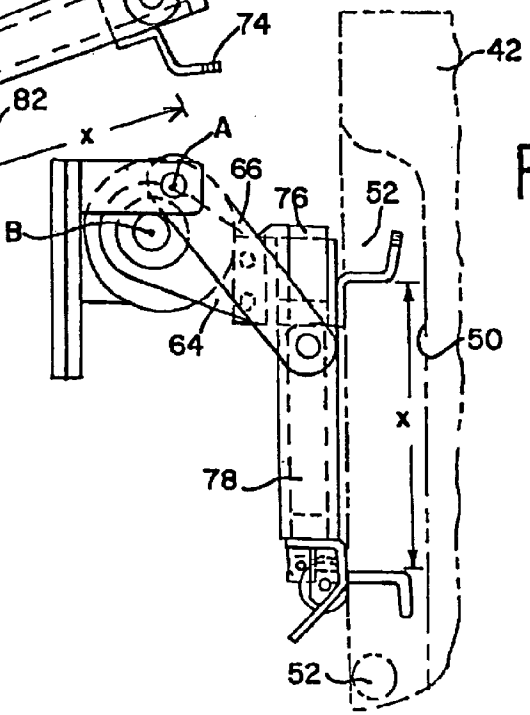
FIG. 4 is a side view of the lifter of FIG. 1 in an intermediate position, with a refuse container shown partially in dashed lines.
Figure 8:
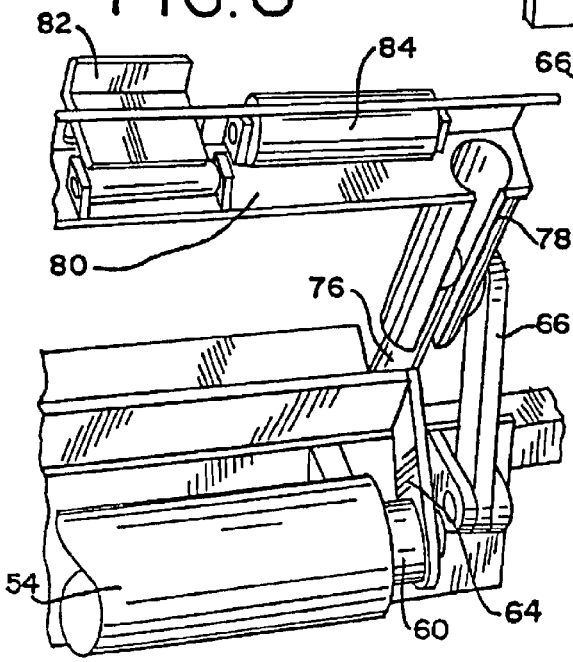
FIG. 8 is a perspective view of the lifter of FIG. 6 with the lifter in a raised position as it would be for lifting, tilting and dumping refuse containers.
Figure 11:
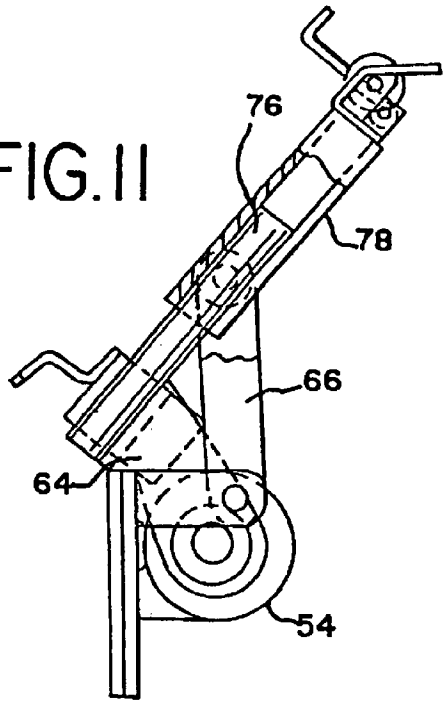
FIG. 11 is a side view of the lifter assembly of FIG. 9, in a raised and inverted position comparable FIG. 5, partially in section.
Figure 10:
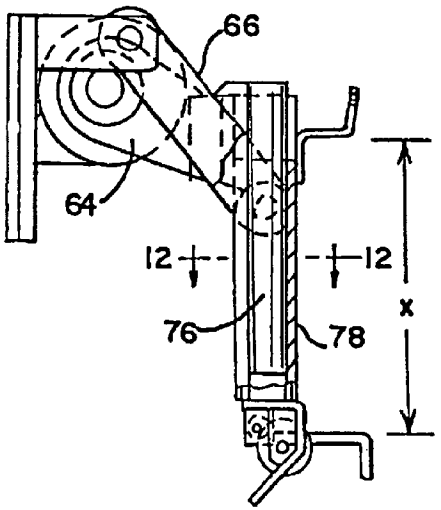
FIG. 10 is a side view of the lifter assembly of FIG. 9, in an intermediate position comparable to FIG. 4, partially in section.
Figure 9:
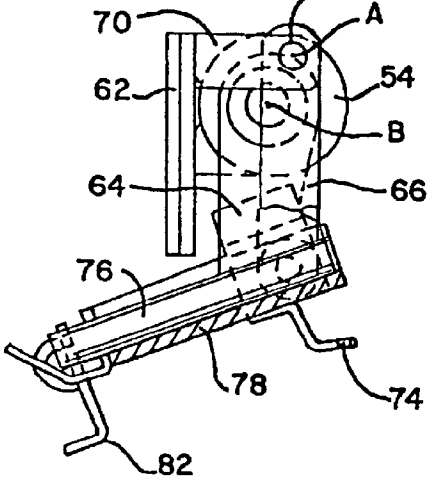
FIG. 9 is a side view of the lifter assembly of FIG. 1, in a retracted position comparable FIG. 3, partially in section.
Figure 12:
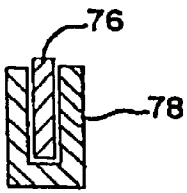
FIG. 12 is a cross sectional view taken along line 12—12 in FIG. 10, but of an alternative embodiment of the present invention.
Figure 13:
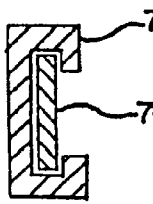
FIG. 13 is a cross sectional view taken along line 12—12 in FIG. 10, but of a further alternative embodiment of the present invention.
Figure 14:
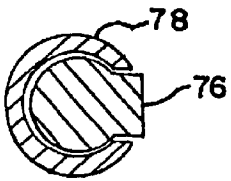
FIG. 14 is a cross sectional view taken along line 12—12 in FIG. 10, but of another alternative embodiment of the present invention.
Figure 15:
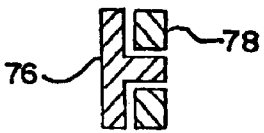
FIG. 15 is a cross sectional view taken along line 12—12 in FIG. 10, but of another alternative embodiment of the present invention.
Figure 16:
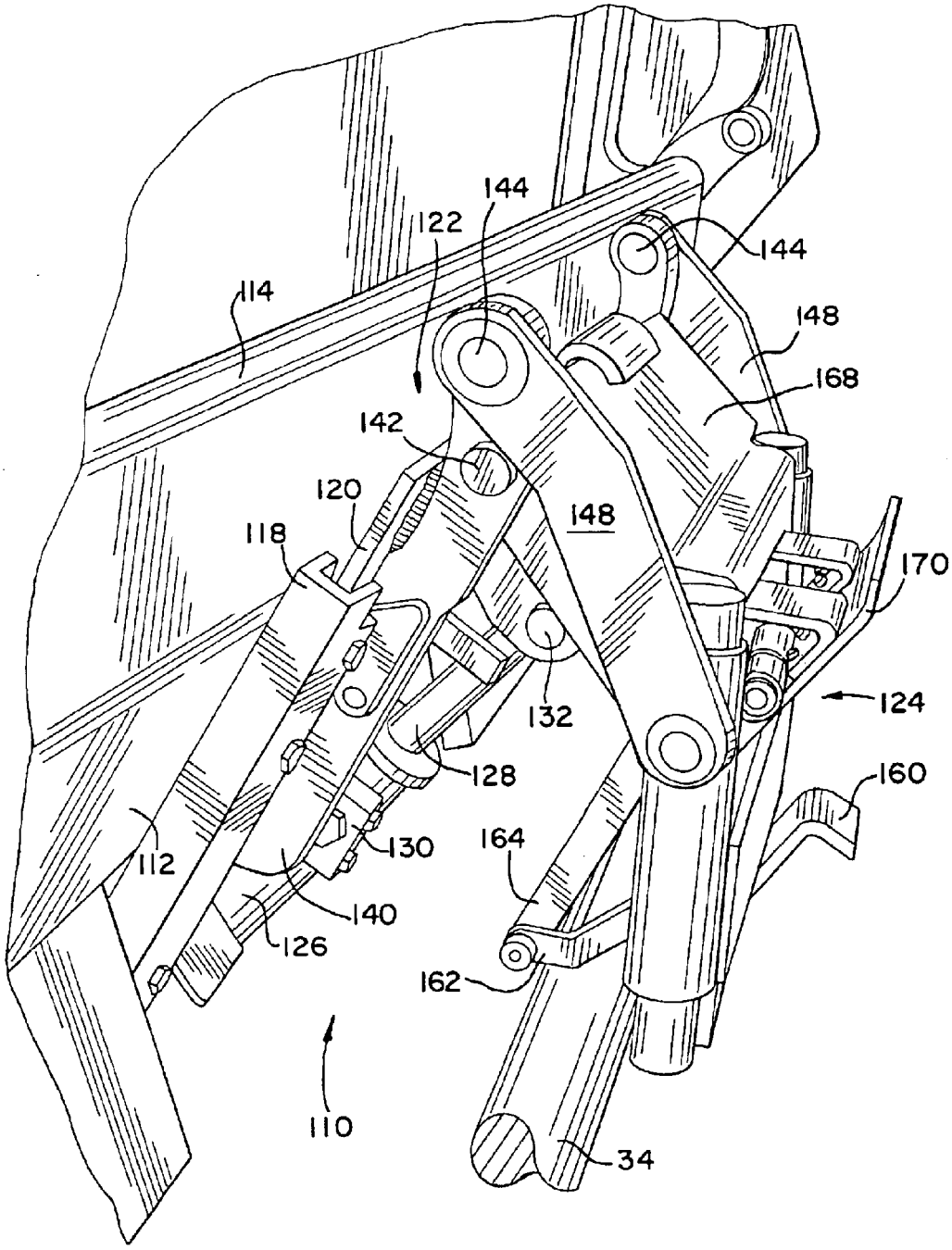
FIG. 16 is a perspective view of a second embodiment of a lifter embodying additional aspects of the present invention with the lifter support in the second position and the lifter assembly between the retracted and extended positions.

As a result of the relatively movable arrangement between members 76 and 78, and the displaced axes of the pivot 68 and motor drive shaft 50, the spacing between the upper and lower cross members 72 and 80 varies depending on the rotational position of carriage. Turning to FIGS. 3–5, FIG. 3 is a side view of the lifter assembly when the carriage is in the fully retracted position. As may be seen there, the axis of rotation A of the pivot than 68 is located above and slightly rearward of the axis of rotation B of the hydraulic motor rotary actuator shaft. In the fully retracted position, as shown in FIG. 3, the relatively movable members 76 and 78 are telescoped together, thereby reducing the distance X between the upper hook or saddle 74 and lower hook or saddle 78. As best seen in FIGS. 3*a*, 5*a* and 8, the outer member 78 includes the slot 79 at the rear to receive the lift arm 64 in the retracted position and allow the members 76 and 78 to fully telescope together to reduce the distance between the upper and lower hooks 74 and 82.

As the rotary actuator 54 rotates counterclockwise, the carriage moves from the fully retracted position to an intermediate position such as shown FIG. 4. This displaced axes of the pivot 68 and motor actuator shaft 60 causes the actuator arm 66 to push against the outer member 78, causing it to slide downwardly relative to the inner member 76, and increasing the spacing X between the upper saddle or hook 74 and the lower saddle or hook 82. In the position illustrated in FIG. 4, the upper and lower hooks 74 and 82 extend into the recessed area 50 of the container and are located between the lift bars 52, with the upper saddle or hook 74 engaging under and beginning to lift the upper lift bar 42 of the refuse collection container 42, and the lower hook being located above lower lift bar of the refuse container.

As the lifter 40 continues to rotate upwardly, the upper hook 74 lifts the refuse container, and continued upward rotation of the lifter also results in the actuator arms 66 continuing to push the lower hook away from the upper hook (due to the displaced axes of the pivot and the motor shaft) so that the lower hook engages over the lower lift bar of the collection container, to the position generally shown in FIG. 5. At the position shown in FIG. 5, the weight of the container has generally shifted such that the lower bar of the collection container rests against the lower hook or saddle 82 of the lifter. At this point, the distance between the upper and lower hooks or saddles are such as to effectively capture the refuse collection container on the lifter so that the refuse container cannot fall from the lifter. More specifically, the upper and lower hooks are spaced apart nearly the same distance that the upper and lower lift bars of the refuse container are spaced apart, so that the container cannot shift enough that either lift bar can be removed from its respective hook. The relative motion of the hooks or saddles is reversed as the lifter rotates back toward the retracted position, with the inner and outer members 76 and 78 sliding or telescoping together, drawing the cross members 72 and 80, and their respective hooks, closer together for release of the container.

As noted earlier, the container carriage, with relatively movable hooks, could be a separate assembly operatively attached to the relatively movable members 76 and 78 for moving the hooks. In the illustrated embodiment the relatively movable members 76 and 78 are directly attached, respectively, to the cross members 72 and 80, which tends to reduce cost and simplify construction.

Because the height or length of the carriage actually shortens as it moves from the extended position to the retracted position, it is particularly useful on refuse collection trucks of the type using a tipper or kick bar 34 as illustrated in FIG. 1. In other words, the length of the lifter is sufficiently reduced as it moves to the retracted position so that it can pass over the tipper bar and not interfere with the use of the tipper bar for dumping substantially larger multi-yard containers or dumpsters. In addition, as is apparent in FIG. 3, when the lifter is in the retracted position, the entire carriage 58 is located below and substantially forward of the rearward-most edge of lifter. This aids in providing a thin profile when the lifter to be mounted to the rear of refuse collection trucks that are also used in handling commercial collection chores.

In residential collection, the tipper bar or other lifting device for the large multi-yard containers typically would not be used, and the roll out residential carts would be lifted, tilted and dumped by the lifter 40 of the present invention. However, should the collection truck need to stop at a commercial location where a large multi-yard container needs to be dumped, lifter 40 would be rotated to the fully retracted position, such as shown in FIG. 3, where it will not interfere with the rotation of the tipper bar, and will provide a sufficiently thin profile that would allow the large containers to be dumped over the lifter without damaging the carriage of the lifter 40.

There are variety of techniques used for mounting lifters on the side or rear of refuse collection trucks area, some of which provide more protection to the lifter than others. For example, refuse collection trucks as delivered from a manufacturer, typically have a rearward-most reinforcing member along the hopper lip, which is commonly referred to as the sill or sill beam. Although not usually recommended by the manufacturer, lifters such as the present invention may be mounted in recesses cut into the sill to recess the motor and other parts of the lifter and better protect them from damage during dumping of much larger collection containers. Alternatively, a so-called sill extender may be mounted to the original sill, and the dump or lifter mounted within recesses in the sill extender. Alternatively, the lifter may be mounted directly on the original sill, and small bumpers placed on either side to help protect the lifter. The effect is similar, the lifter motor and other parts are better protected from damaging contact with the large multi-yard containers when they are dumped. The lifter of the present invention also may be mounted to the rear of trucks without using any of the above techniques, with the thin profile allowing large containers to be dumped, and the carriage being protected from damage due to its very compact retracted position. As can be seen in FIG. 3, the carriage 58 of the lifter 40 of the present invention, when in the retracted position, extends in a generally forward, almost horizontal position below the hopper and below any sill, sill extender, frame member or other surface to which lifter is mounted. In this retracted position, the lift arms 64 and actuator arms 66 extend generally vertically, providing for a very compact lifter, with minimum exposure of the lifter to potential damage from the lifting of large refuse collection containers by a tipper bar or by such other lifting device, such as a cable and winch, as may be used on the particular collection vehicle.

In addition to the hooks 80, the lower cross member 80 also mounts a pair of rollers 84 to protect the wall of the container as it is lifted, tilted and dumped. As noted earlier, the hooks 74 and 82 extend into the recessed area 50 of the collection container and the rollers serve to support the container wall to prevent gouging by the lower hook or damage to the container as the lower hook moves downwardly during rotation of the carriage. In addition, the lower hooks 82 may be spring loaded to permit a degree of flexing in the event that the hook should engage against the wall of the container.

Although the lifter 40 is shown in its preferred embodiment, various modifications may be made without departing from the invention. Referring to FIG. 8, which depicts the lifter in a raised and inverted position, the slot in the outer member 78, for receiving the lift arm in the retracted position, is readily apparent. As illustrated, the slot extends the full length of the outer member 78. However, because the lift arm only enters the upper portion of the slot, the lower portion of the slot is unnecessary and the outer member 78 may be continuous and free of a slot in the lower portion, for example the lower half, for increased strength and durability.

Also, in the illustrated and preferred embodiment, the inner member 76 is a solid cylindrical steel rod and the outer member 78 is a hollow steel sleeve in which the steel rod slidably moves. Other arrangements or configuration for members 76 and 78 may be used which allow for relative motion without departing from the present invention. For example, the members 76 and 78 could be of any other shape, such as C-shaped or U-shaped or simply flat shaped as illustrated, for example, in FIGS. 12–15, provided that relative movement may be achieved between the two members to cause, directly or indirectly, relative movement between the upper and lower hooks or saddles 74 and 82.

Turning to the drawings, there is seen in FIGS. 16–25 a further embodiment of a refuse container lifter, generally designated 110, according to other aspects of the present invention. This embodiment is similar, in part, to that described above. However, this embodiment lends itself particularly well to mounting to the underside of the hopper, with no change required to the sill. More particularly, this embodiment employs a unique sequencing action for movement of the lifter between a stowed position below the hopper and a raised and tipped position for dumping a refuse cart.

In this embodiment, the lift arm and actuator arm (and the carriage mounted thereon) are pivotally mounted to a movable or slidable lifter support member that first linearly moves the retracted carriage from under the sill before the carriage is rotated to engage and dump a container. This sequence is reversed when the lifter is moved from the extended to the retracted or stowed position. The sequential movement allows the lifter to be retracted to a more compact position under the sill of the hopper (out of the way of any large commercial container dumping or loading dock parking), insures clearance between the lifter and the tipper bar that may be mounted on the truck, and may be mounted without any required cutting into the hopper sill or sill extension.

As with the embodiment of FIGS. 1–15, the lifter 110 is typically, although not necessarily, mounted to a rear-loading refuse collection truck having a curved bottom hopper wall 112 that slopes upwardly to terminate in a rearward sill or sill edge 114, over which refuse is dumped into the collection hopper. In this embodiment, however, the lifter assembly is preferably welded or otherwise attached to the underside of the hopper instead of vertical base plate 62.

Figure 17:
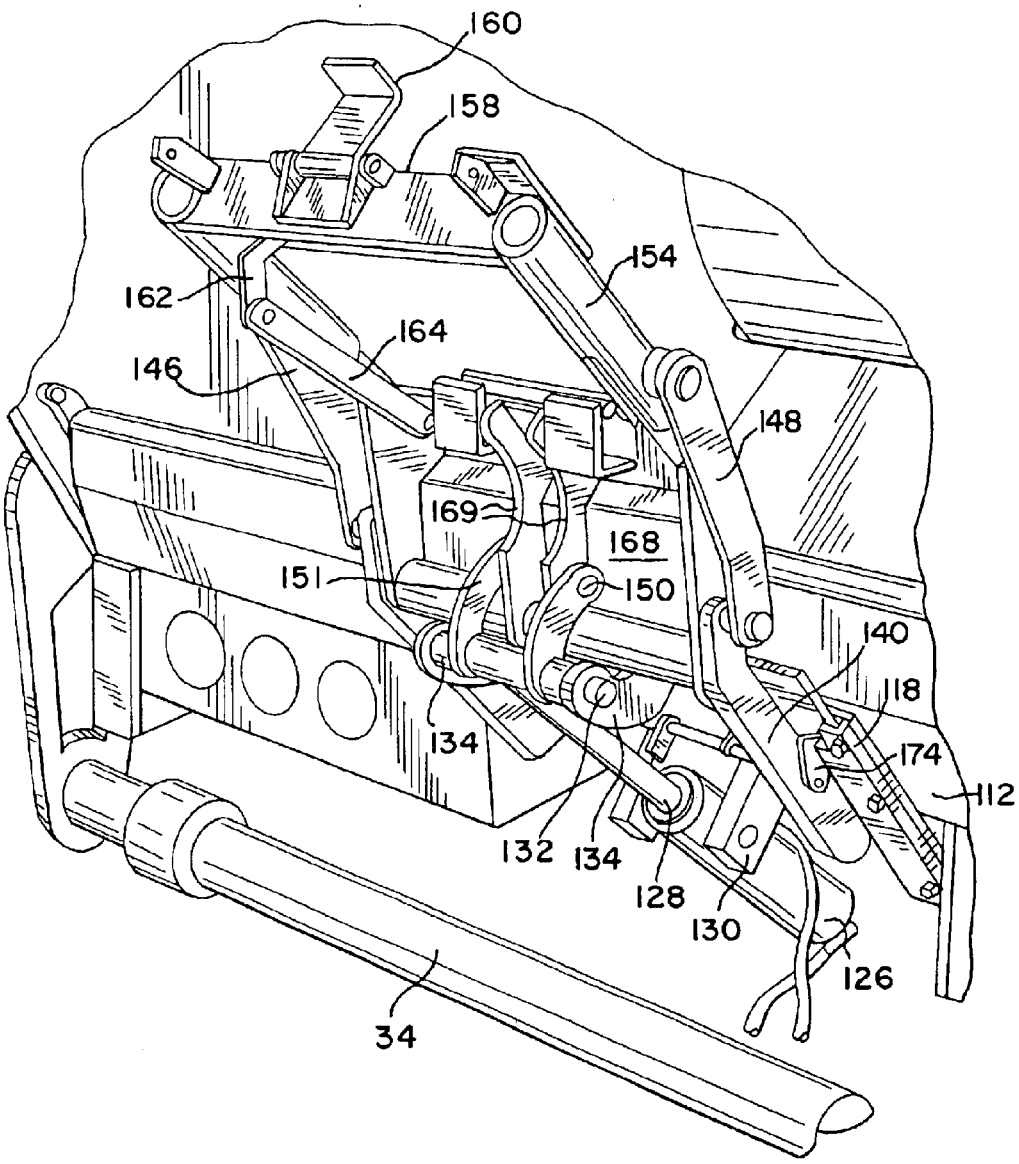
FIG. 17 is a perspective view of the lifter of FIG. 16 with the lifter in the extended position for dumping a collection container.
Figure 18:
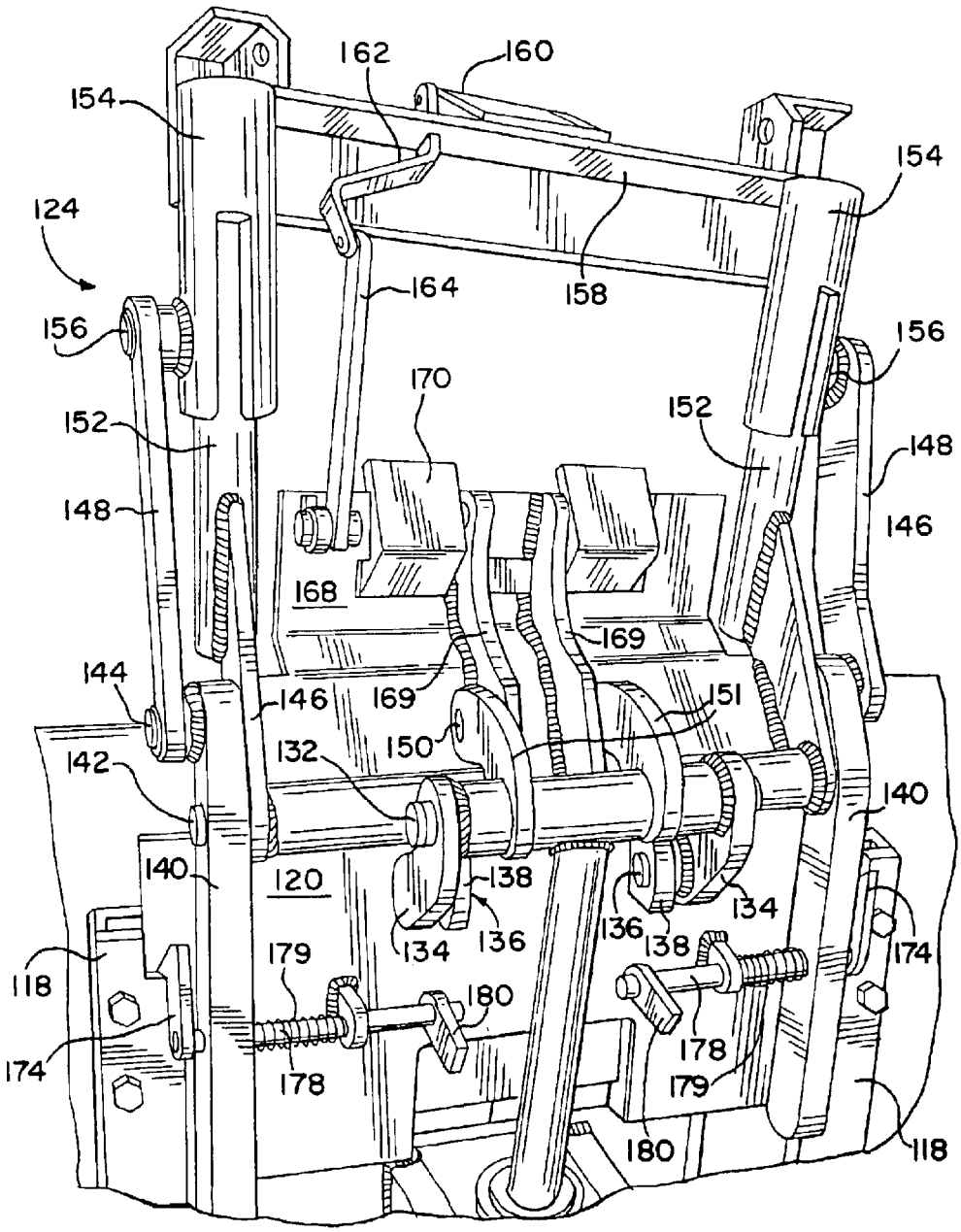
FIG. 18 is a further perspective view of the lifter of FIG. 16 with the lifter in the extended position.
Figure 24:
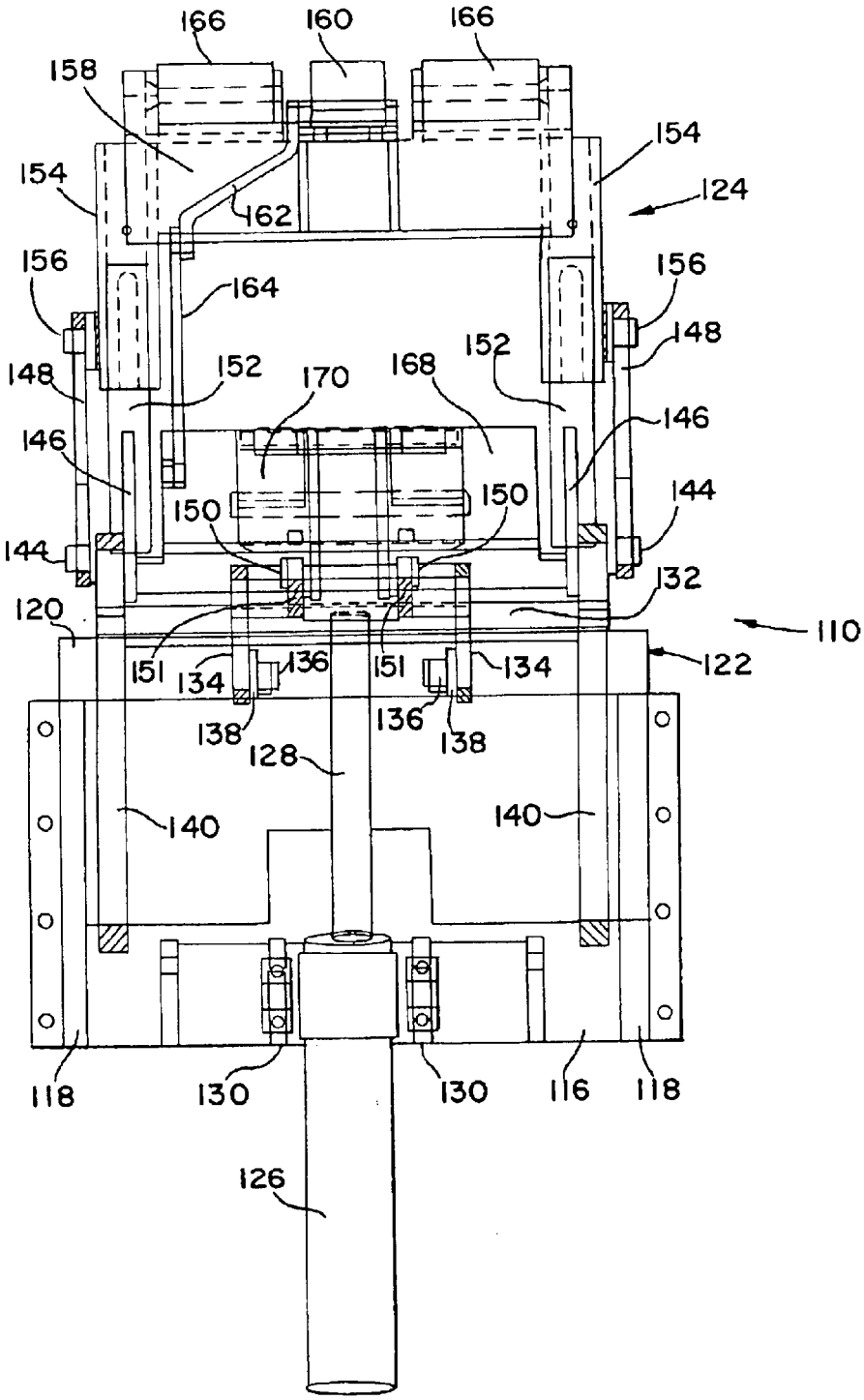
FIG. 24 is a bottom view of the lifter of FIG. 17 in the extended position.
Figure 26:
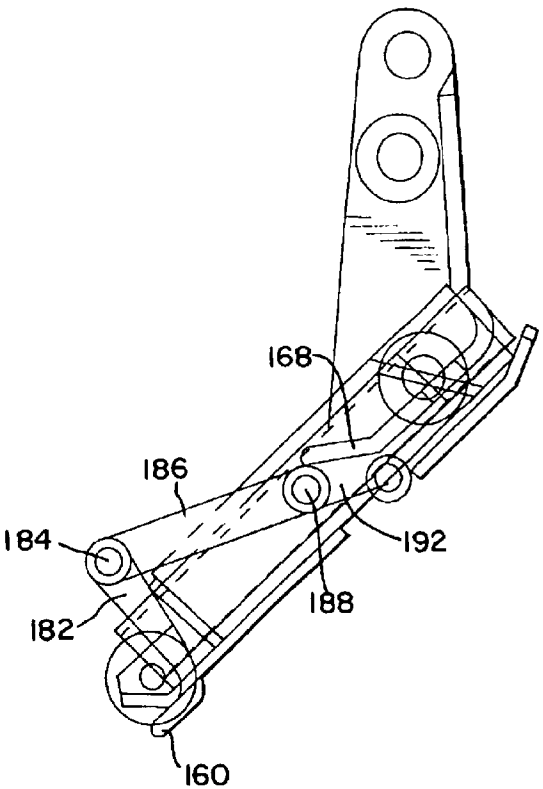
FIGS. 26–28 are side views of an alternate embodiment of the carriage structure of the lifter of FIGS. 16–25 moving from the retracted position to the extended position.
Figure 25:
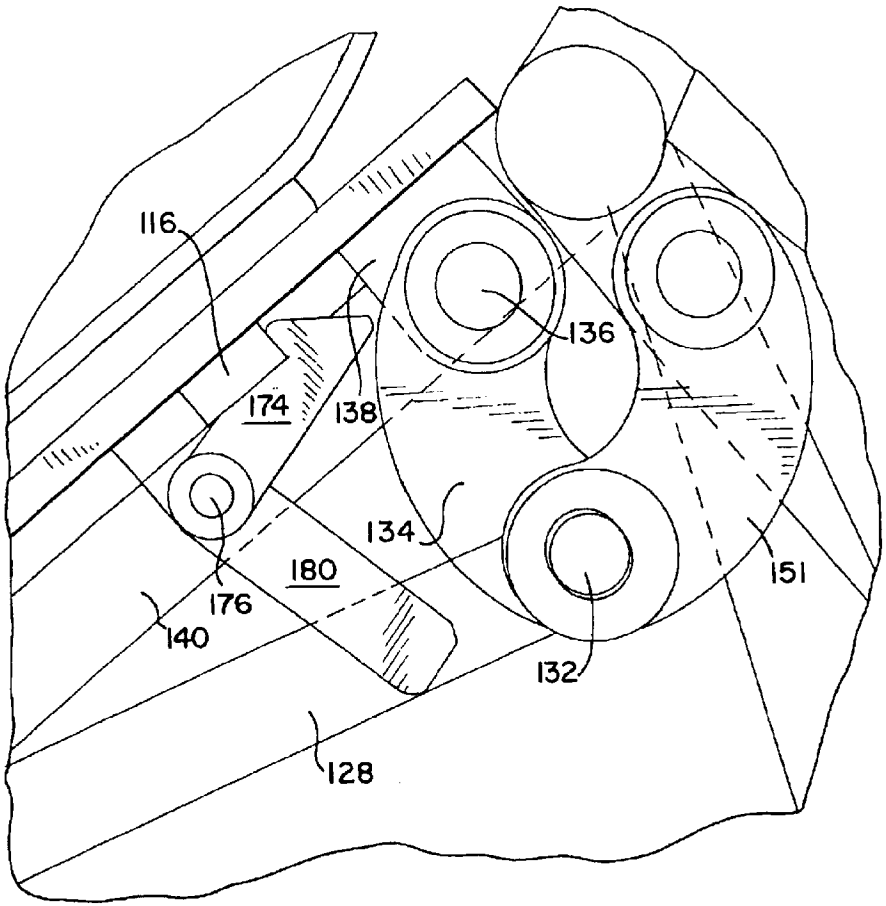
FIG. 25 is an enlarged fragmentary side view of a position of the lifter of FIG. 16 showing first and second links and connection of the power source (actuator rod) to the links.
Figure 28:
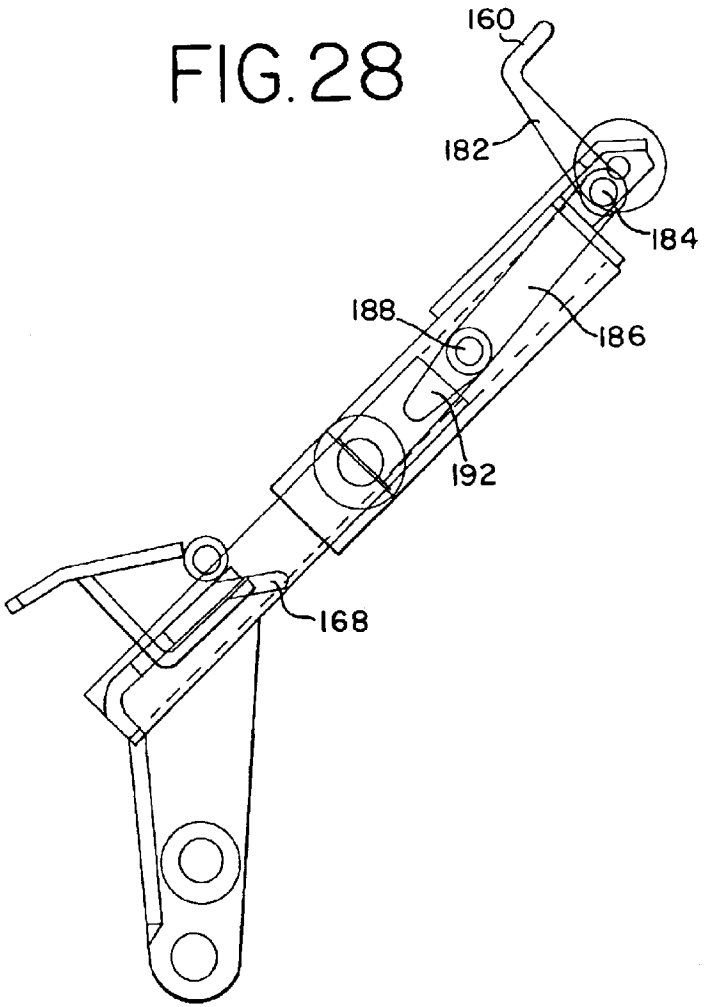
Figure 27:
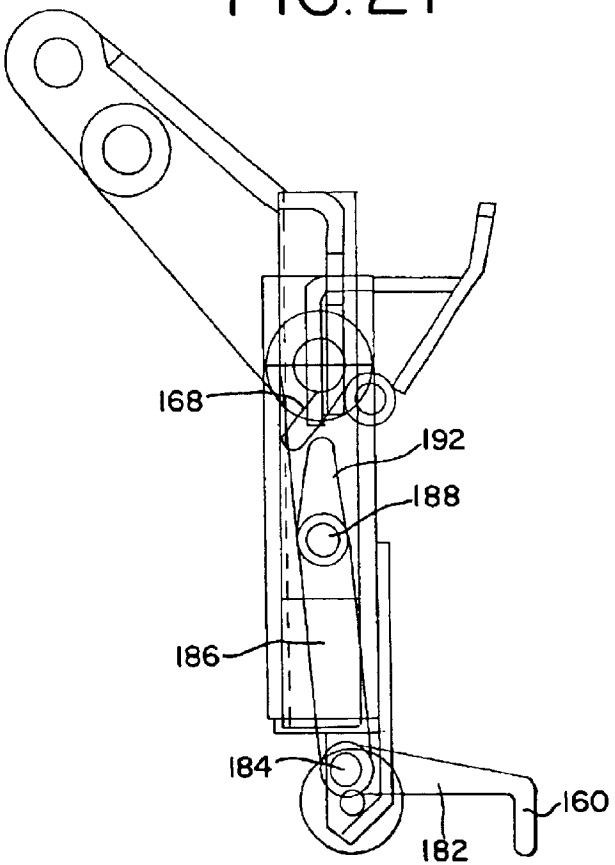
Figure 29:
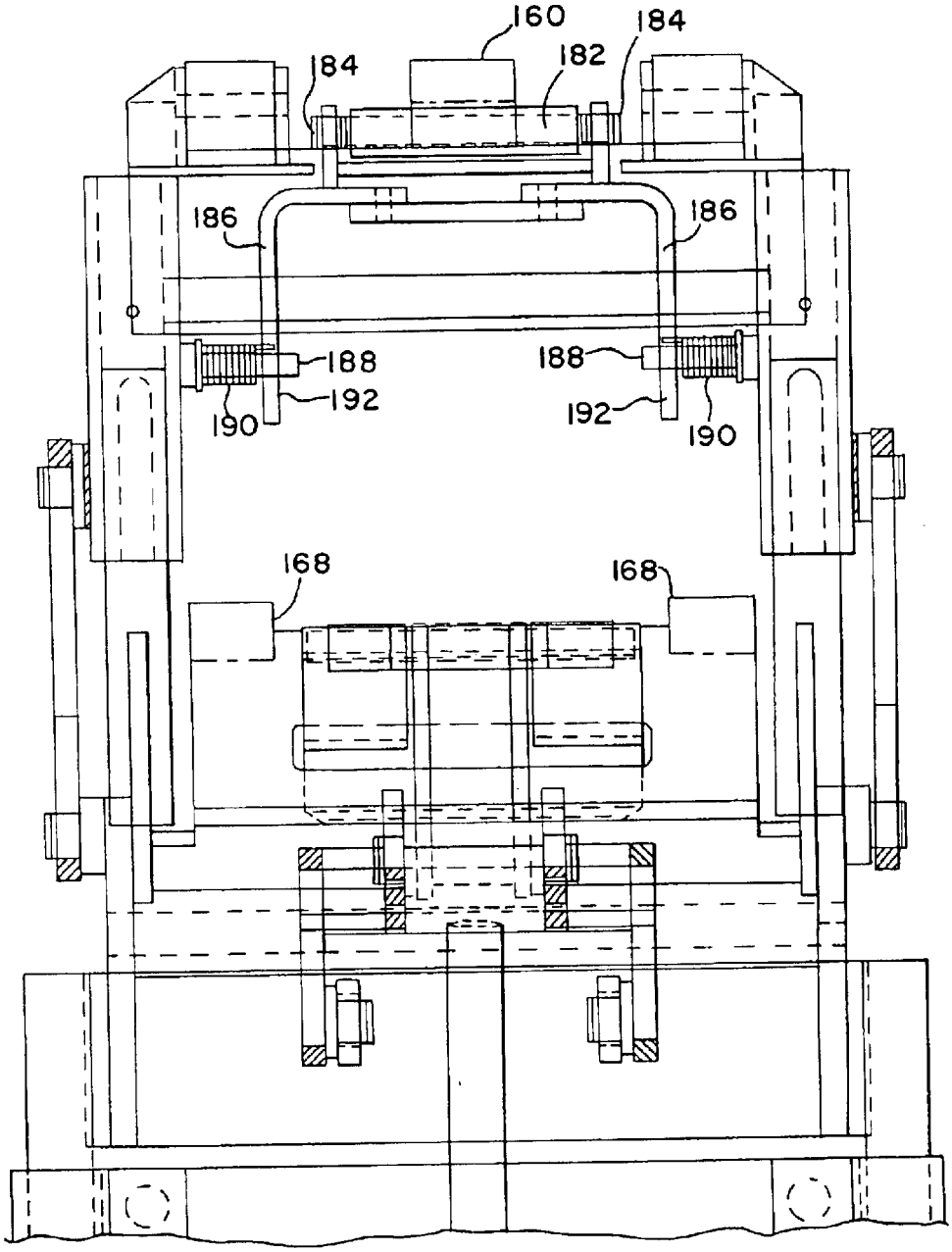
FIG. 29 is a bottom view of the carriage of the lifter of FIGS. 26–28 in the extended position.

As best seen in FIGS. 17, 18 and 24, the lifter 110 includes a track member 116 having opposed, elongated U-shaped channel members 118 that capture the opposed edges of a plate member 120 comprising part of a traveler or slide member 122 to which the carriage 124 is mounted. The slide member 122 is moved back and forth within the track 116 by means of a piston cylinder 126 and piston rod 128. The piston cylinder 126 is pivotally mounted to the exterior of the bottom hopper wall 112 by means of a yolk 130. The free end of the piston rod 128 carries a transverse pivot connection 132, which is connected by a pair of links 134, each captured by a pivot connection 136 carried by a bracket 138 secured by, e.g., welding to the plate 120 of the slide member 122. Thus, linear movement of the slide member 122 is provided by reciprocation of the piston rod 128 with respect to its cylinder 126.

In keeping with the invention, the same piston rod 128 and cylinder 130 that move the slide member 122 also move the carriage 124 that is mounted to the slide member 122. To this end, the slide member 122 includes a pair of spaced-apart elongated webs 140. Each web 140 carries two spaced-apart pivot connections 142, 144 that receive one end of a lift arm 146 and an actuator arm 148, respectively, which are similar in structure and function to the lift arm 64 and actuator arm 66 discussed above. The other ends of the lift arm 146 and actuator arm 148 are attached to the container carriage 124, as will be described in greater detail below.

A plate 168 extends between and is welded to the lift arms 146. The underside of plate 168 includes brackets 169, each of which include a pivot connection 150 that is connected by a link 151 to the transverse pivot connection 132 on the piston rod 128. Thus, movement of the piston rod 128 also serves to rotate the lift arm 146 about the pivot connection 142.

The construction of the carriage 124 is substantially as described in connection with the first mentioned embodiment, with each side of the carriage 124 including two relatively moveable or telescoping members 152, 154. Inner telescoping member 152, as illustrated, is a solid cylindrical rod to which the end of the lift arm 146 is rigidly affixed as, for example, by welding. Outer telescoping member 154, as illustrated, is a steel sleeve including a pivot connection 156 for attaching the actuator arm 148.

A lower cross member 158 extends between and is attached to each of the outer telescoping members 154. A downwardly facing hook or saddle 160 is pivotally attached to the lower cross member 158 for engaging the lower-most lift bar 52 on a refuse collection container 42. The lower hook 160 is rotatable downwardly to engage the lower-most lift arm simultaneously with the movement of the two telescoping members away from each other. Specifically, the lower hook 160 has a link 162 rigidly affixed thereto on one end and having its other end pivotally connected to another link 164 that is, in turn, pivotally connected to the underside of plate 168, which extends between lift arms 146. In addition to the saddle 160, the lower cross member 158 also mounts a pair of rollers 166 to protect the wall of the container as it is lifted, tilted and dumped.

Alternatively, the lower hook 160 may be mounted on a spring-loaded member that moves the lower hook outwardly to engage the lower bar of the container to be dumped as the inner and outer telescoping members move apart from each other. As seen in FIGS. 26–29, the lower hook 160 is mounted on a cross member 182 that is connected on opposite sides by pivots 184 to generally L-shaped arms 186. Each arm 186 is mounted for rotation on a stud 188 mounted by, e.g., welding to the outer telescoping member 154. A torsion spring 190 is mounted on each stud 188 to bias the arms from the retracted position (FIG. 26) into the extended position (best seem in FIGS. 27 and 28), in which the lower hook 160 is in position to engage the lower bar 52 of the refuse container 42. In order to retract the lower hook 160, each arm 186 includes a portion 192 that extends beyond the connection of the arm 186 to its mounting stud 188. The portion 192 is engaged by an angled portion of the upper cross member 168 as the telescoping members 152, 154 are retracted. The angled portion operates as a cam surface to pivot the arms 186, cross member 182 and lower hook 160 against the force of the springs 190 to the position shown in FIG. 26.

The carriage 124 also includes the upper cross member or plate 168 that extends between the lift arms and carries an upper hook or saddle 170 that serves to engage the uppermost lift bar 52 on the refuse container 42 as the lifter is moved from the retracted to the extended position. The saddle may be freely pivotally mounted such that gravity holds it in an open position for hooking beneath the upper bar of the collection cart. Alternatively, the hook or saddle may be fixed in the container engaging position. As noted above, each end of the upper cross member 168 is welded or otherwise attached, directly or indirectly, to one of the lift arms 146 so that the cross member 168 is moved in unison with the lift arms 146 as they are rotated by the piston rod 126.

Figure 19:
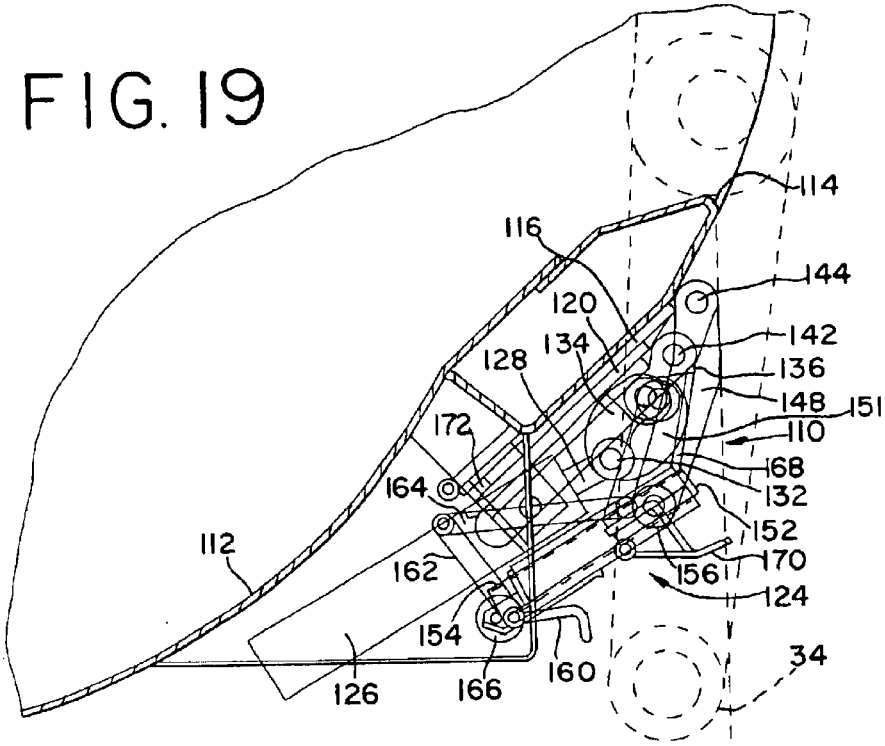
FIGS. 19–23 are side views of the lifter of FIG. 16 showing the lifter support as it moves from the first to the second positions and the lifter carriage, as it moves from the retracted position (FIG. 19) to the extended position (FIG. 23).
Figure 20:
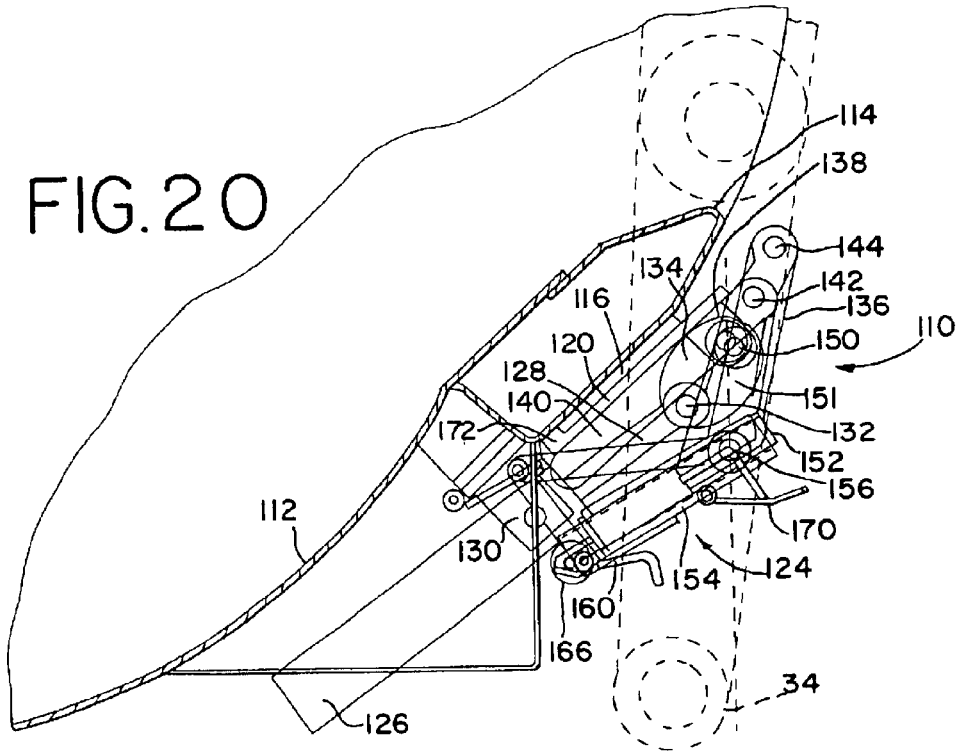
Figure 21:
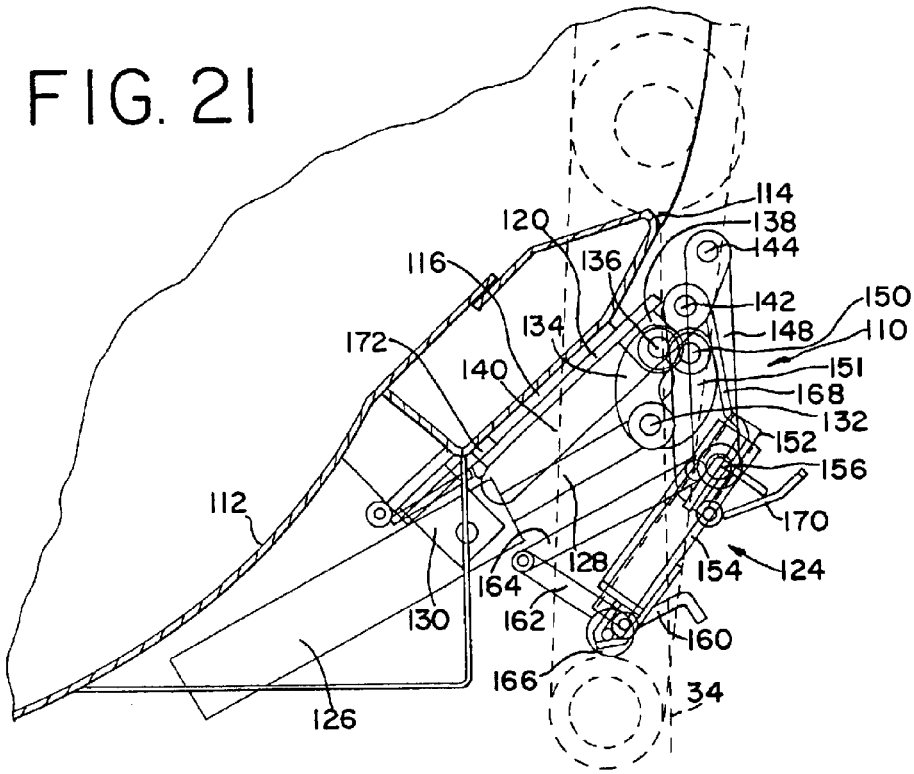
Figure 22:
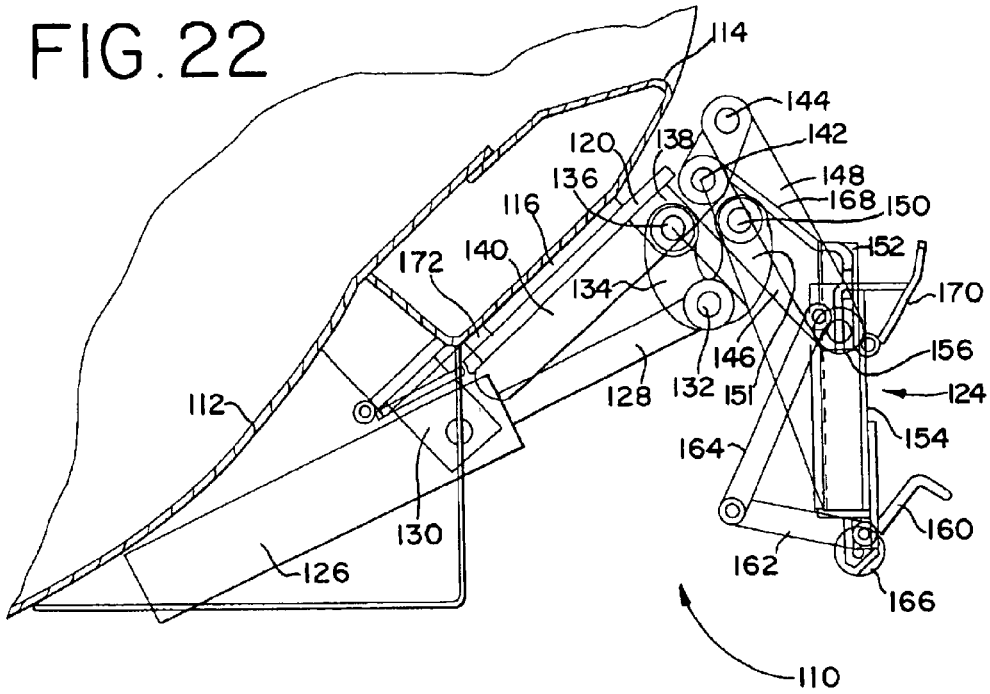
Figure 23:
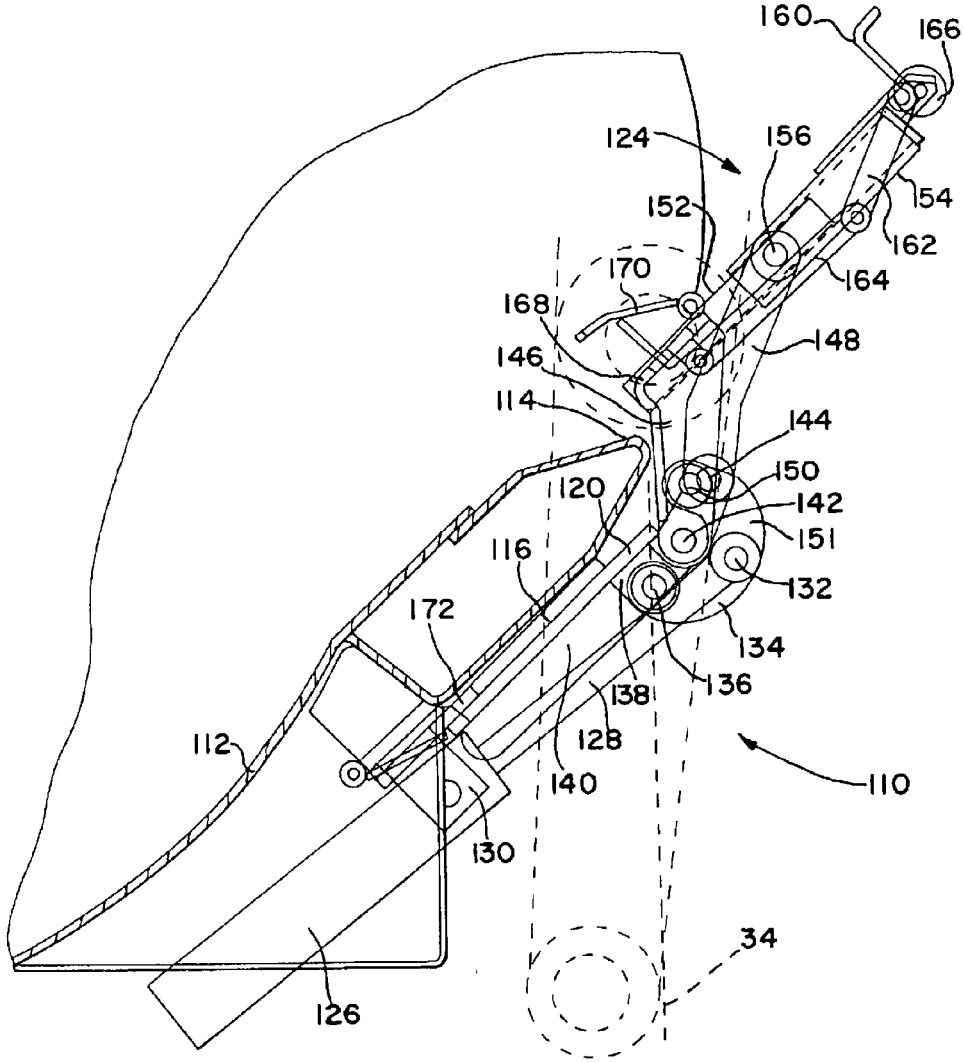

In keeping with one aspect of this embodiment, it is desired that the carriage be moved sequentially from its retracted position beneath the hopper, first linearly along the track so that the carriage clears the tipper bar before the carriage rotates counterclockwise to engage, pick up or dump a refuse container. Similarly, upon retraction from the extended position, it is desired that the carriage first rotate to release the refuse so that when it is linearly retracted, clearance with the tipper bar is again assured. To this end, when in the retracted position, as seen in FIG. 19, the longitudinal axis of the piston rod is at only a slight angle with the U-shaped channels 118 in which the plate 120 slides. There is only a small offset between the pivot connection 132 on the piston rod and the pivot connections 142 and 150 on the lift arm. Thus, as the piston rod 126 moves from its retracted position, the linear force exerted on the slide member 122 to move it rearwardly is substantially greater than the force exerted on the lift arm 146 to pivot it about the pivot connection 142. Thus, the motion of the carriage 124 is initially essentially linear, as the slide member 122 moves along the track member 116, and any slight pivotal motion that results from the small moment arm between pivots 132 and 136 is insufficient to interfere with linear movement of the carriage.

To assist in the sequential motion, the slide member 122 and track 116 are provided with interfering surfaces that limit and stop the rearward movement of slide member 122 with respect to the track 116. After the point is reached where the slide member cannot move rearwardly any further, further extension of the piston rod 128 serves solely to rotate the carriage 124. To limit rearward movement, the slide member 122 may include a lip or tab 172 on its rear edge that catches on the back edge of the track 116 to stop the outward movement of the slide member 122 with respect to the track 116. Then, when this relative movement is arrested, the piston rod 128 will act only to rotate the lift arms 146 about the pivot connection 142, and thus rotate the carriage.

To insure the sequential action in the return direction, i.e., to assure that the carriage 124 is rotated back to the recessed position before the slide is linearly retracted, the slide member includes a pair of pivoting, spring-loaded latches 174 secured to a rod 178 rotatably received in each elongated web 140. The latch 174 is biased by the torsion spring 179 to catch a rear edge of the track member 116 upon full extension of the slide member 122 with respect to the track. The latch prevents the slide from being retracted in the track member until the carriage is rotated back to its retracted position, at which time the end of the piston rod trips a lever arm 180 mounted to the rod 176 to release the latch and allow the slide member to move. Then, the slide member 122 can slide back into the track 116, into the stowed position under the hopper, with the continued retraction of the piston rod 128.

It should be noted that as the carriage 124 moves from the retracted to the extended or dump position, the moment arm between the pivot connection 132 on the piston rod 128 and the pivot connections 142 and 136 about which the lift arm 146 and link 134 rotate, respectively, with respect to the slide member 122 increases. Consequently, the piston rod 128 exerts its maximum torque on the lift arm 146 when it is needed most, i.e., when the carriage 122 is engaging, lifting and dumping the refuse container. Although a common hydraulic piston cylinder may function satisfactorily, a telescopic or multi-stage piston cylinder unit provides the same movement of the piston rod but has a shorter cylinder length. A shorter cylinder length means that the cylinder is less susceptible to impact damage from road debris or surface. As may be seen, for example, in FIG. 17, the cylinder 126 hangs down from trunnion 130. The shorter cylinder of a telescopic or multi-stage piston-cylinder unit does not hang down as far as a normal cylinder and is less susceptible to damage. Any of a wide variety of commercially available telescopic or multi-stage units may be used as described above to reduce the potential for road damage.

Other variations may also be apparent upon further study. While the invention has been described in terms of certain preferred embodiments, there is no intent to limit it to the same. For example, the sequential action of linear extension from under the hopper and then pivoting for lifting and dumping and the reverse sequence of pivoting to a folded or recessed position and then linearly retracting to below the hopper is not limited to the particular carriage construction illustrated and the present invention may, in its broader respects, be used with other lifter carriage constructions. For these reasons, the scope of the invention is defined by the appended claims, and not by the details of the illustrated embodiments.

What is claimed is:

1. A lifter suitable for mounting on the underside of a refuse collection hopper of a refuse collection vehicle for dumping refuse collection containers into the refuse collection hopper, the lifter comprising:

a lifter support movable between a first position below the hopper and a second position spaced from the first position;

a lifter carriage carried by the lifter support and pivotally movable with respect to the lifter support between a retracted position and an extended position for lifting and inverting refuse collection containers to dump the refuse into the collection hopper;

a power source operatively connected to the lifter support and lifter carriage to move the lifter support between the first and second positions and the lifter carriage between the retracted and extended positions, and wherein the power source is operatively secured to the lifter support and lifer carriage so as to move them at least in part sequentially.

2. The lifter of claim 1 further comprising a linkage assembly pivotally connected to the lifter carriage and lifter support, and the power source being secured to the linkage assembly.

3. The lifter of claim 1 wherein the power source is hydraulically activated.

4. The lifter of claim 3 wherein the power source comprises a piston-cylinder unit.

5. The lifter of claim 4 in which the hydraulic piston-cylinder unit is telescopic.

6. The lifter of claim 1 further comprising a first link having first and second ends, the first end being pivotally mounted to the lifter support; a second link having first and second ends, the first end being pivotally mounted to the lifter carriage; the second ends of the first and second links being pivotally secured together, the power source being operatively coupled to the first and second links.

7. The lifter of claim 6 wherein the power source comprises a linearly movable actuator and the actuator is pivotally secured to selected of the links.

8. The lifter of claim 7 further comprising a connecting rod extending between and pivotally connecting the second ends of the links along a common axis, and wherein the actuator is secured to the connecting rod.

9. The lifter of claim 7 wherein the actuator is pivotally secured to the first link.

10. The lifter of claim 1 further comprising a lock for retaining the lifter support in the second position, the lock being releasable upon movement of the lifter carriage to the retracted position.

11. The lifter of claim 1 further comprising a slide track for attachment to the underside of the collection hopper, the lifter support being slidably movable within the slide track.

12. The lifter of claim 1 wherein the lifter carriage includes a relatively movable upper hook and a lower hook, the hooks being movable between a first spaced apart position when the lifter carriage is in the retracted position and a second spaced apart position when the carriage is in the extended position, the hooks being spaced apart a greater distance in the second position than in the first position.

13. A refuse collection vehicle comprising a refuse collection hopper including a lower sill edge and bottom floor a lifter mounted on the underside of the floor, the lifter comprising:

a lifter support movable between a first position below the hopper floor and a second position spaced from the first position and closer to the sill edge;

a lifter carriage carried by the lifter support and pivotally movable with respect to the lifter support between a retracted position and an extended position for lifting and inverting refuse collection containers to dump the refuse into the collection hopper;

a power source operatively connected to the lifter support and lifter carriage to move the lifter support between the first and second positions and the lifter carriage between a the retracted and extended positions, and wherein the power source is operatively secured to the lifter support and lifter carriage so as to move them at least in part sequentially.

14. The lifter of claim 13 further comprising a linkage assembly pivotally connected to the lifter carriage and lifter support, and the power source being secured to the linkage assembly.

15. The lifter of claim 13 wherein the power source is hydraulically activated.

16. The lifter of claim 15 wherein the power source comprises a piston-cylinder unit.

17. The lifter of claim 16 in which the hydraulic piston-cylinder unit is telescopic.

18. The lifter of claim 16 in which the piston-cylinder unit is mounted to allow angular movement of the unit.

19. The lifter of claim 18 in which the piston-cylinder unit is trunnion mounted.

20. The lifter of claim 13 further comprising a first link having first and second ends, the first end being pivotally mounted to the lifter support; a second link having first and second ends, the first end being pivotally mounted to the lifter carriage; the second ends of the first and second links being pivotally secured together, the power source being operatively coupled to the first and second links.

21. The lifter of claim 20 wherein the power source comprises a linearly movable actuator and the actuator is pivotally secured to selected of the links.

22. The lifter of claim 21 further comprising a connecting rod extending between and pivotally connecting the second ends of the links along a common axis, and wherein the actuator is secured to the connecting rod.

23. The lifter of claim 21 wherein the actuator is pivotally secured to the first link.

24. The lifter of claim 13 further comprising a lock for retaining the lifter support in the second position, the lock being releasable upon movement of the lifter carriage to the retracted position.

25. The lifter of claim 13 further comprising a slide track for attachment to the underside of the collection hopper, the lifter support being slidably movable within the slide track.

26. The lifter of claim 13 wherein the lifter carriage includes a relatively movable upper hook and a lower hook, the hooks being movable between a first spaced apart position when the lifter carriage is in the retracted position and a second spaced apart position when the carriage is in the extended position, the hooks being spaced apart a greater distance in the second position than in the first position.

* * * * *